US011804161B1

(12) United States Patent
Gao et al.

(10) Patent No.: US 11,804,161 B1
(45) Date of Patent: Oct. 31, 2023

(54) DISPLAY PANEL AND DISPLAY DEVICE

(71) Applicants: Wuhan Tianma Micro-Electronics Co., Ltd., Wuhan (CN); Wuhan Tianma MicroElectronics Co., Ltd. Shanghai Branch, Shanghai (CN)

(72) Inventors: Yana Gao, Shanghai (CN); Xingyao Zhou, Shanghai (CN); Gaojun Huang, Shanghai (CN)

(73) Assignees: WUHAN TIANMA MICRO-ELECTRONICS CO., LTD., Wuhan (CN); WUHAN TIANMA MICROELECTRONICS CO., LTD. SHANGHAI BRANCH, Shanghai (CN)

( * ) Notice: Subject to any disclaimer, the term of this patent is extended or adjusted under 35 U.S.C. 154(b) by 0 days.

(21) Appl. No.: 18/079,635

(22) Filed: Dec. 12, 2022

(30) Foreign Application Priority Data

Sep. 6, 2022 (CN) ..... 202211086050.7

(51) Int. Cl.
*G09G 3/20* (2006.01)

(52) U.S. Cl.
CPC ..... *G09G 3/20* (2013.01); *G09G 2300/0408* (2013.01); *G09G 2300/0413* (2013.01); *G09G 2300/0426* (2013.01); *G09G 2300/0439* (2013.01); *G09G 2300/0842* (2013.01); *G09G 2310/08* (2013.01); *G09G 2320/0233* (2013.01)

(58) Field of Classification Search
CPC ..... G09G 3/20; G09G 2300/0408; G09G 2300/0413; G09G 2300/0426; G09G 2300/0439; G09G 2300/0842; G09G 2310/08; G09G 2320/0233
See application file for complete search history.

(56) References Cited

U.S. PATENT DOCUMENTS

2021/0012743 A1* 1/2021 Lee ..... G09G 3/3258
2021/0013235 A1* 1/2021 Toda ..... G02F 1/1368
2021/0013289 A1* 1/2021 Li ..... G09G 3/3233

* cited by examiner

*Primary Examiner* — Sejoon Ahn
(74) *Attorney, Agent, or Firm* — Anova Law Group, PLLC

(57) ABSTRACT

Display panel and display device are provided. The display panel includes a first light-transmitting group, a first non-display area, and a display area; and a plurality of pixel driving circuits and a plurality of drive signal lines. The first non-display area surrounds the first light-transmitting group, the display area surrounds the first non-display area, and the first light-transmitting group includes at least two first light-transmitting areas arranged along a first direction. The plurality of pixel driving circuits is in the display area, a pixel driving circuit of the plurality of pixel driving circuits includes a data writing module, and a drive signal line of the plurality of drive signal lines is electrically connected to a control terminal of the data writing module.

20 Claims, 23 Drawing Sheets

DISPLAY PANEL AND DISPLAY DEVICE

CROSS-REFERENCE TO RELATED APPLICATION

This application claims priority of Chinese Patent Application No. 202211086050.7, filed on Sep. 6, 2022, the entire contents of which are hereby incorporated by reference.

FIELD OF THE DISCLOSURE

The present disclosure generally relates to the field of display technology and, more particularly, relates to a display panel and a display device.

BACKGROUND

A display panel generally includes a display area for image display and a non-display area for arranging peripheral drive circuits. Light-emitting elements arranged in an array in the display area are respectively electrically connected to the drive circuits through pixel driving circuits. At present, the display area of a common display panel is generally a rectangle with regular shape, i.e., number of light-emitting elements in each row is basically same and writing of data signals in a row of light-emitting elements is simultaneously controlled by drive signal lines.

With a development of display technology, the display panel has a higher and higher screen-to-body ratio. A full-screen display has received widespread attention due to a narrow or even borderless display effect thereof. At present, a display device such as a mobile phone or tablet computer often needs to reserve space for a commonly used electronic photosensitive device such as a front camera, an infrared sensing device, a fingerprint identification device or the like. Part of the reserved space is not provided with light-emitting elements, so that number of loads on the drive signal lines in the display area corresponding to the part of the reserved space is different from number of loads on the drive signal lines in a normal display area. Therefore, a difference between a writing time of data signals of light-emitting elements in the display area corresponding to the reserved space and a writing time of data signals of light-emitting elements in the normal display area is large, resulting in a poor display uniformity.

BRIEF SUMMARY OF THE DISCLOSURE

One aspect of the present disclosure provides a display panel. The display panel includes a first light-transmitting group, a first non-display area, and a display area; and a plurality of pixel driving circuits and a plurality of drive signal lines. The first non-display area surrounds the first light-transmitting group, the display area surrounds the first non-display area, and the first light-transmitting group includes at least two first light-transmitting areas arranged along a first direction. The plurality of pixel driving circuits is in the display area, a pixel driving circuit of the plurality of pixel driving circuits includes a data writing module, and a drive signal line of the plurality of drive signal lines is electrically connected to a control terminal of the data writing module. The plurality of drive signal lines includes first drive signal lines, a first drive signal line includes a first line segment in the display area and a first connection line segment located in the first non-display area and connected to the first line segment, and the first line segment is on a side of the first light-transmitting group along the first direction. The first connection line segment at least partially surrounds the first light-transmitting areas and is at least partially between two adjacent first light-transmitting areas.

Another aspect of the present disclosure provides a display device. The display device includes a display panel. The display panel includes a first light-transmitting group, a first non-display area, and a display area; and a plurality of pixel driving circuits and a plurality of drive signal lines. The first non-display area surrounds the first light-transmitting group, the display area surrounds the first non-display area, and the first light-transmitting group includes at least two first light-transmitting areas arranged along a first direction. The plurality of pixel driving circuits is in the display area, a pixel driving circuit of the plurality of pixel driving circuits includes a data writing module, and a drive signal line of the plurality of drive signal lines is electrically connected to a control terminal of the data writing module. The plurality of drive signal lines includes first drive signal lines, a first drive signal line includes a first line segment in the display area and a first connection line segment located in the first non-display area and connected to the first line segment, and the first line segment is on a side of the first light-transmitting group along the first direction. The first connection line segment at least partially surrounds the first light-transmitting areas and is at least partially between two adjacent first light-transmitting areas.

Other aspects of the present disclosure can be understood by a person skilled in the art in light of the description, the claims, and the drawings of the present disclosure.

BRIEF DESCRIPTION OF THE DRAWINGS

Accompanying drawings, which are incorporated in and constitute part of the present specification, illustrate embodiments of the present disclosure and together with a description, serve to explain principles of the present disclosure.

DETAILED DESCRIPTION

Various exemplary embodiments of the present disclosure will be described in detail with reference to the accompanying drawings. It should be noted that, unless specifically stated otherwise, a relative arrangement of components and steps, numerical expressions and numerical values set forth in the embodiments do not limit the scope of the present disclosure.

The following description of at least one exemplary embodiment is merely illustrative and is not intended to limit the present disclosure and application or use thereof.

Techniques, methods, and apparatus known to a person skilled in the art may not be discussed in detail, but where appropriate, such techniques, methods, and apparatus should be considered as part of the present specification.

In all examples shown and discussed herein, any specific value should be construed as illustrative only and is not used as a limitation. Accordingly, other examples of exemplary embodiments may have different values.

It should be noted that like numerals and letters refer to like items in the following figures, and therefore, once an item is defined in one accompanying drawing, further discussion in the subsequent accompanying drawing may not be required.

Figure 1:
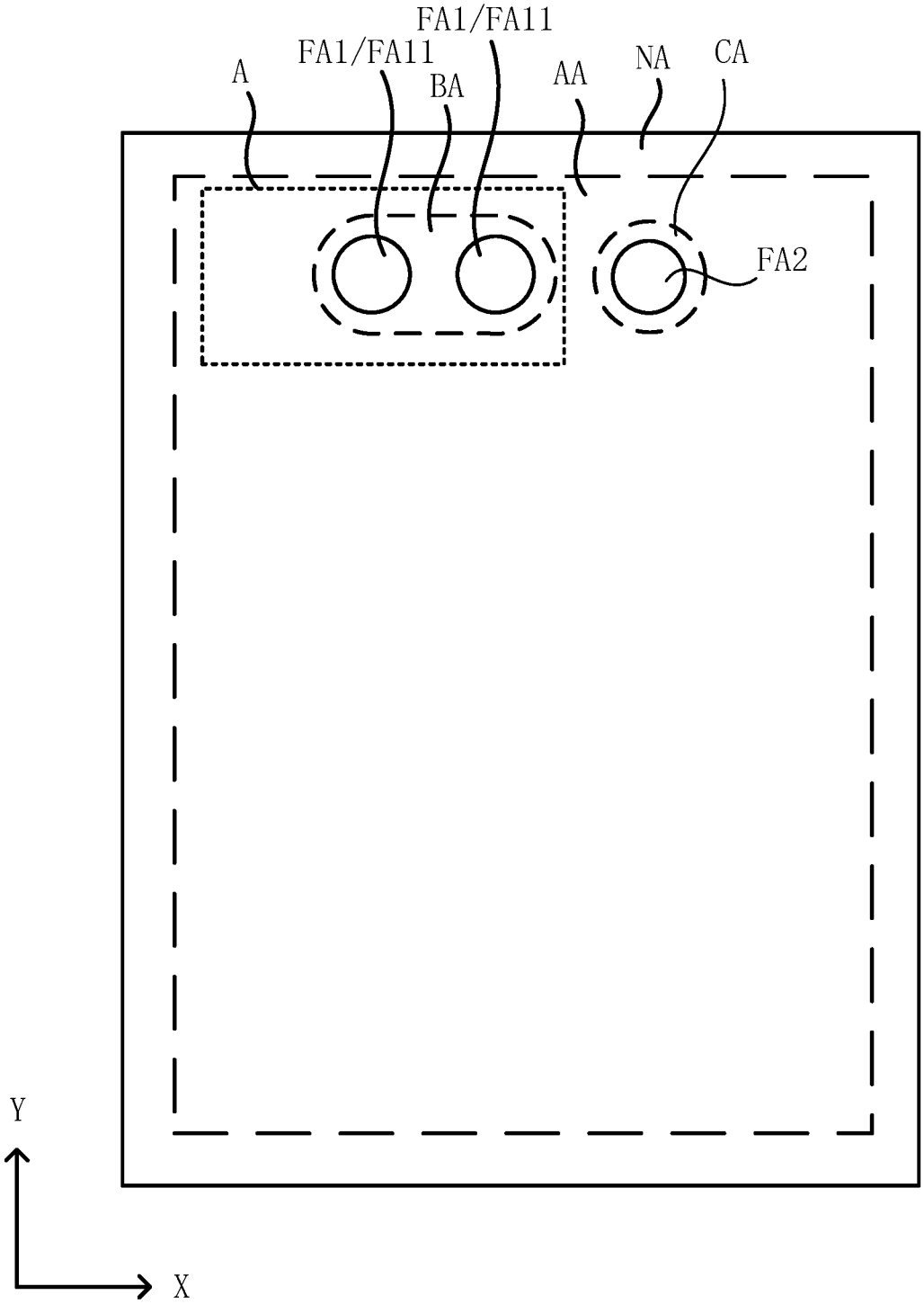
FIG. 1 illustrates a planar view of a display panel consistent with various embodiments of the present disclosure.
Figure 2:
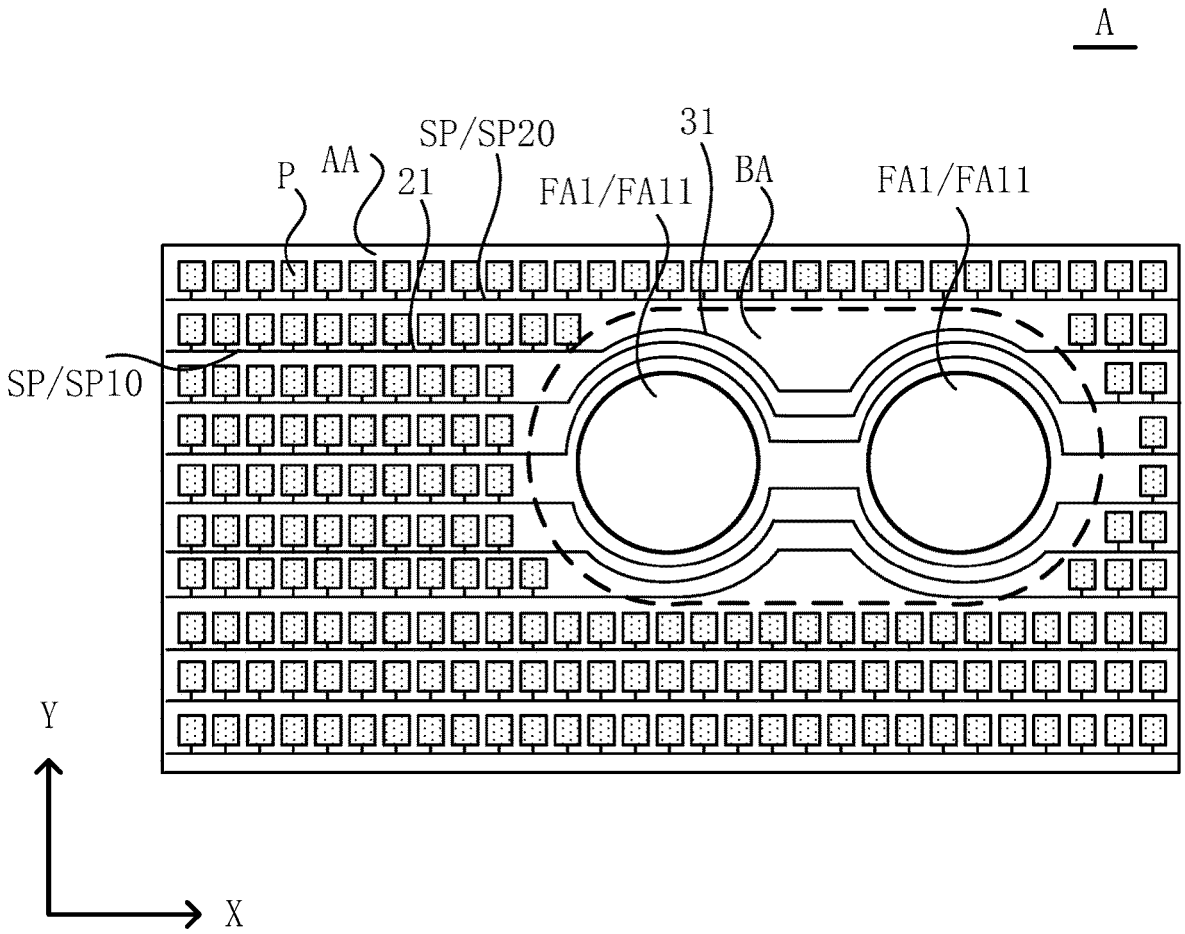
FIG. 2 illustrates an enlarged view of portion A of the display panel shown in FIG. 1.
Figure 3A:
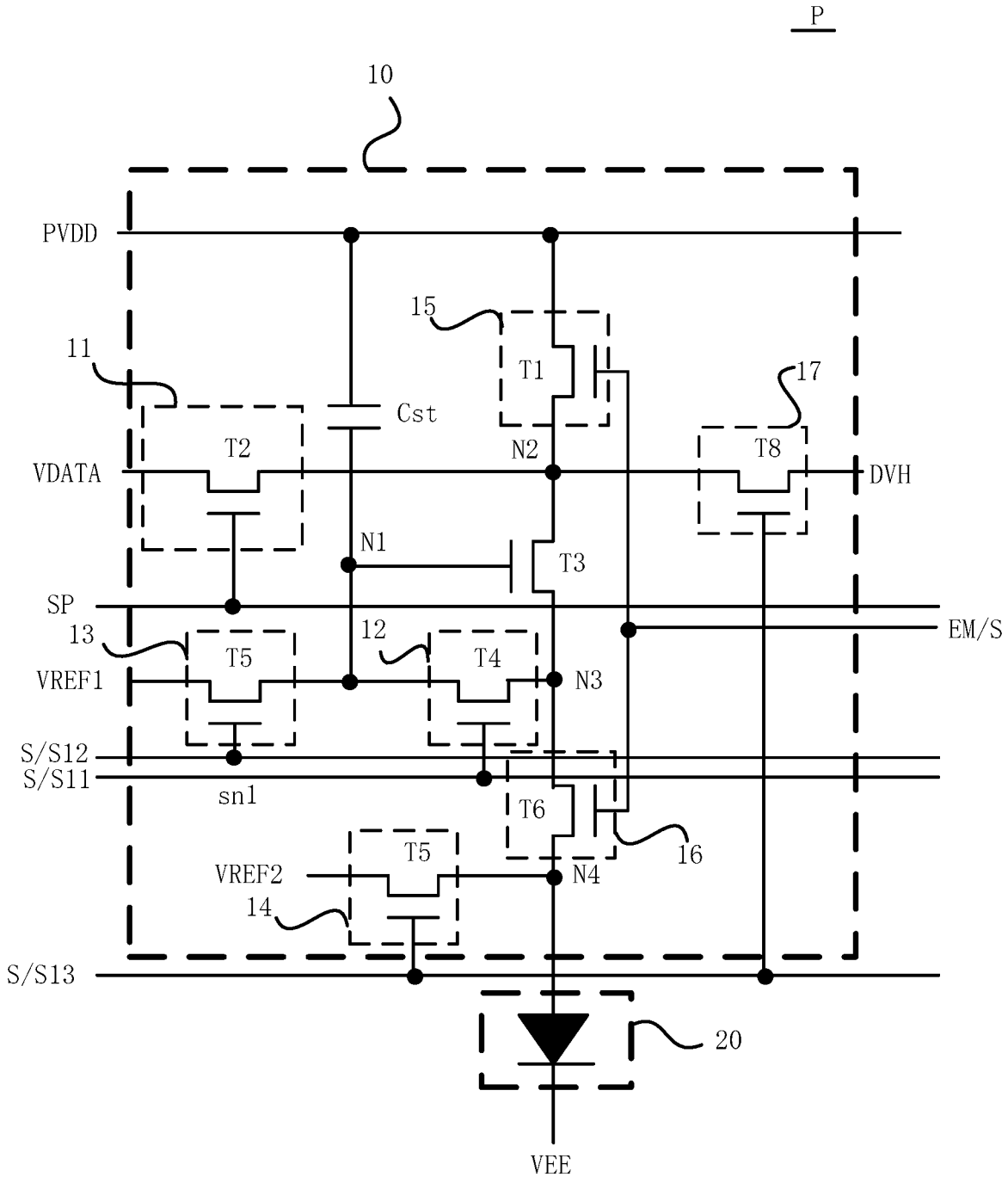
FIG. 3A illustrates a circuit diagram of a drive circuit consistent with various embodiments of the present disclosure.
Figure 3B:
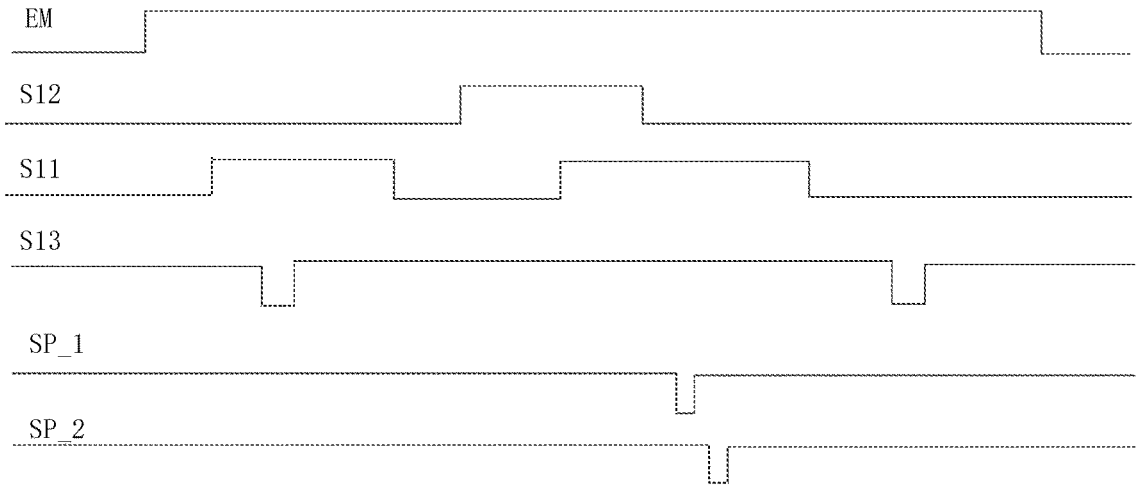
FIG. 3B illustrates a timing diagram of the drive circuit shown in FIG. 3A.

FIG. 1 illustrates a planar view of a display panel consistent with various embodiments of the present disclosure. FIG. 2 illustrates an enlarged view of portion A of the display panel shown in FIG. 1. FIG. 3A illustrates a circuit diagram of a drive circuit consistent with various embodiments of the present disclosure. FIG. 3B illustrates a timing diagram of the drive circuit shown in FIG. 3A. Referring to FIG. 1, FIG. 2, FIG. 3A and FIG. 3B, a display panel is provided by one embodiment. The display panel includes a first light transmission group FA1, a first non-display area BA and a display area AA. The first non-display area BA surrounds the first light transmission group FA1. The display area AA surrounds the first non-display area BA. The first light-transmitting group FA1 includes at least two first light-transmitting areas FA11 arranged along a first direction X.

A first light-transmitting area FA11 has relatively good light-transmitting properties, and devices such as photosensitive elements can be arranged in a region corresponding to the first light-transmitting areas FA11. The first light-transmitting group FA1 includes at least two first light-transmitting areas FA11, which is conductive to arranging a larger number of devices in an area corresponding to the first light-transmitting group FA1, so that the display panel can have more functions. Optionally, a vertical projection pattern of a first light-transmitting areas FA11 on a plane where the display panel is located is a circle. In other embodiments, the vertical projection pattern of the first light-transmitting area FA11 on the plane where the display panel is located may also be a rectangle, ellipse, or another shape, which is not specifically limited herein and may be determined according to actual conditions.

In some optional embodiments, light transmission requirements of the first light transmission area FA11 in the display panel are relatively high. Accordingly, no subpixels P or complete subpixels may be arranged in the first light-transmitting area FA11, and the first light-transmitting area FA11 are not used for display, so that a light transmittance of the first light-transmitting area FA11 can be improved. Optionally, no wiring is arranged in the first light-transmitting area FA11, so that the light transmittances of the first light-transmitting area FA11 can be improved. Therefore, a wiring that originally needs to extend through the first light-transmitting area FA11 can be wounded through the first non-display area BA to realize a signal transmission of the wiring in each area of the display area AA.

It should be noted that, FIG. 1 and FIG. 2 only exemplarily illustrate the display panel including one first light-transmitting group FA1. The one first light-transmitting group FA1 includes two first light-transmitting areas FA11. In other embodiments, the display panel may also include two or more first light-transmitting groups FA1. One first light-transmitting group FA1 may also include another number of first light-transmitting areas FA11, which are not specifically limited herein, and may be determined according to actual conditions. FIG. 1 and FIG. 2 only exemplarily illustrate that the display area AA surrounds the first non-display area BA. In other embodiments, the display area AA may also only partially surround the first non-display area BA, which may be determined according to actual conditions and is not detailed herein.

The display panel further includes a plurality of pixel driving circuits 10 and a plurality of drive signal lines SP. The plurality of pixel driving circuits 10 is in the display area AA. A pixel driving circuit 10 includes a data writing module 11, a drive signal line SP is electrically connected to a control terminal of the data writing module 11, and a turning-on or turning-off of the data writing module 11 is controlled by a signal on the drive signal line SP, so that a writing time of data signals in the pixel driving circuit 10 can be controlled.

The plurality of drive signal lines SP in the display panel includes first drive signal lines SP10. A first drive signal line SP10 includes a first line segment 21 in the display area AA and a first connection line segment 31 located in the first non-display area BA and connected to the first line segment 21. The first line segment 21 is on a side of the first light-transmitting group FA1 along the first direction X. Due to an arrangement of the first light-transmitting group FA1 and the first non-display area BA, there is at least one first drive signal line SP10 in the display panel. The first line segment 21 of the first drive signal line SP10 are in the display area AA, and the first connection line segment 31 connected to the first line segment 21 are in the first non-display area BA, thereby realizing a signal transmission on the first drive signal line SP10.

The plurality of drive signal lines SP in the display panel further includes conventional drive signal lines SP20 not extending through the first non-display area BA. The first drive signal line SP10 extends through the first non-display area BA, and the pixel driving circuits 10 are in the display area AA, so that number of pixel driving circuits 10 electrically connected to a conventional drive signal line SP20 is greater than number of pixel driving circuits 10 electrically connected to the first drive signal line SP10.

The first connection line segment 31 at least partially surrounds the first light-transmitting areas FA11, and the first connection line segment 31 is at least partially between two adjacent first light-transmitting areas FA11. That is, the first connection line segment 31 of the first drive signal line SP10 can be wounded in an area between the two adjacent first light-transmitting areas FA11 in the first light-transmitting group FA1, thereby effectively increasing a set length of the first connection line segment 31 in the first drive signal line SP10 and increasing a resistance value of the first drive signal line SP10. Therefore, a load on the first drive signal line SP10 can be increased, and a load difference due to a difference between number of pixel driving circuits 10 electrically connected to the first drive signal line SP10 and numbers of pixel driving circuits 10 electrically connected to the conventional drive signal line SP20 can be effectively alleviated, thereby effectively alleviating a difference between a writing time of data signals in the pixel driving circuits 10 electrically connected with the first drive signal line SP10 and a writing time of data signals in the pixel driving circuits 10 electrically connected to the conventional drive signal line SP20, and improving display uniformity of the display panel.

Figure 4:
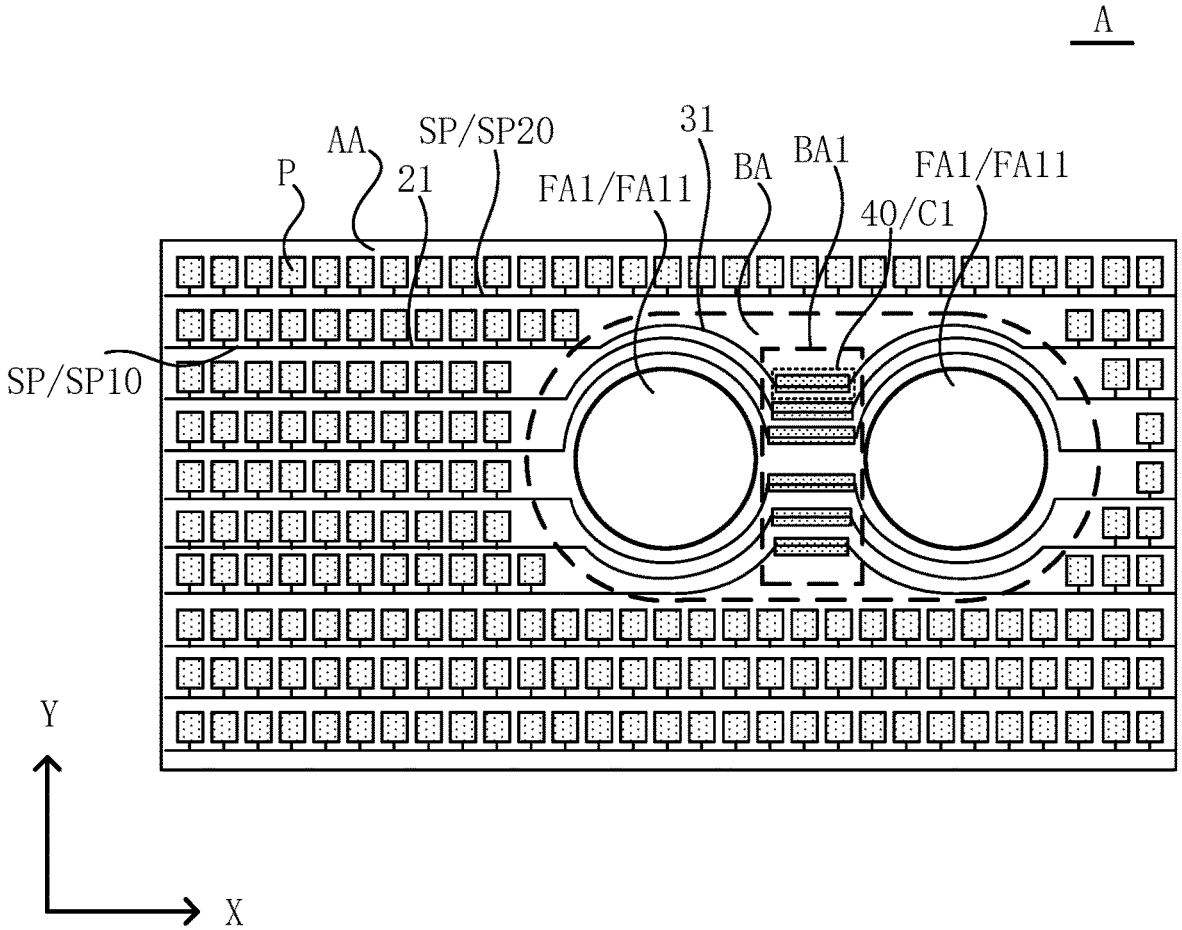
FIG. 4 illustrates another enlarged view of the portion A of the display panel shown in FIG. 1.

FIG. 4 illustrates another enlarged view of the portion A of the display panel shown in FIG. 1. Referring to FIG. 1, FIG. 3A and FIG. 4, in some optional embodiments, the first non-display area BA includes a compensation area BA1 between two adjacent first light-transmitting areas FA11. The compensation area BA1 includes a plurality of compensation parts 40 electrically connected to first connection line segments 31.

Specifically, an area between two adjacent first light-transmitting areas FA11 in the first non-display area BA is not used for display. The compensation area BA1 can be arranged between the two adjacent first light-transmitting areas FA11, and a plurality of compensation parts 40 can be arranged in the compensation area BA1. The first connection line segment 31 in the first drive signal line SP10 can be electrically connected to a compensation part 40, which effectively increases a load on the first connection line segment 31 in the first drive signal line SP10, that is, effectively increases a load on the first drive signal line SP10, thereby further alleviating a load difference caused by a difference in number of pixel driving circuits 10 electrically connected to the first drive signal line SP10 and number of pixel driving circuits 10 electrically connected to the conventional drive signal line SP20, further alleviating a difference between a writing time of data signals in the pixel driving circuits 10 electrically connected to the first drive signal line SP10 and a writing time of data signals in the pixel driving circuits 10 electrically connected to the conventional drive signal line SP20, and improving display uniformity of the display panel.

Figure 5:
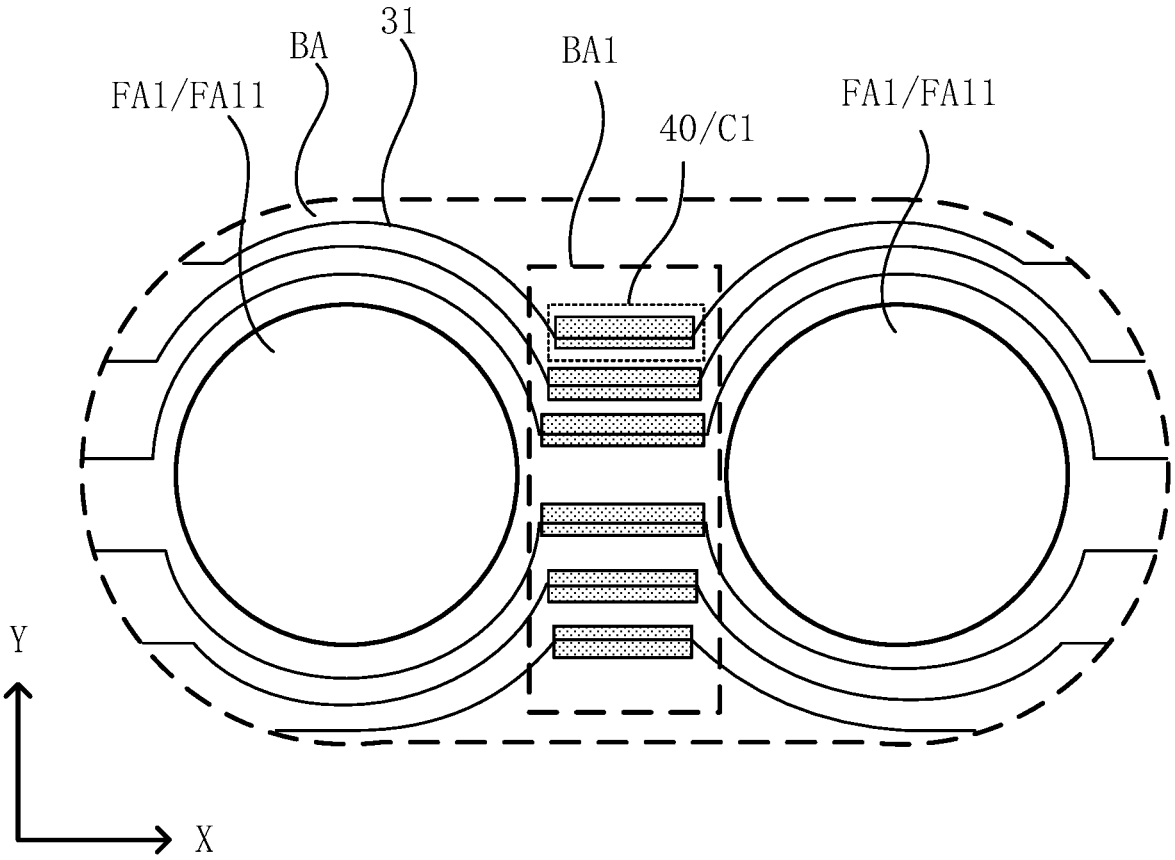
FIG. 5 illustrates an enlarged view of a first non-display area in the display panel shown in FIG. 4.

FIG. 5 illustrates an enlarged view of a first non-display area in the display panel shown in FIG. 4. Referring to FIG. 1, FIG. 3A, FIG. 4 and FIG. 5, in some optional embodiments, a compensation part of the plurality of compensation parts 40 includes a first capacitor C1.

Specifically, a plurality of first capacitors C1 may be arranged in the compensation area BA1. The first connection line segment 31 in the first drive signal line SP10 may be electrically connected to a first capacitor C1, so that a load on the first drive signal line SP10 can be increased.

Referring to FIG. 1, FIG. 3A, FIG. 4 and FIG. 5, in some optional embodiments, part of the first connection line segment 31 is multiplexed as a first plate of a first capacitor C1.

Specifically, the first connection line segment 31 is at least partially between two adjacent first light-transmitting areas FA11. The first connection line segment 31 may be at least partially in the compensation area BA1 between the two adjacent first light-transmitting areas FA11. Part of the first connection line segment 31 is multiplexed into a first plate of a first capacitor C1, so that the first connection line segment 31 in the first drive signal line SP10 can be electrically connected to the first capacitor C1.

Figure 6:
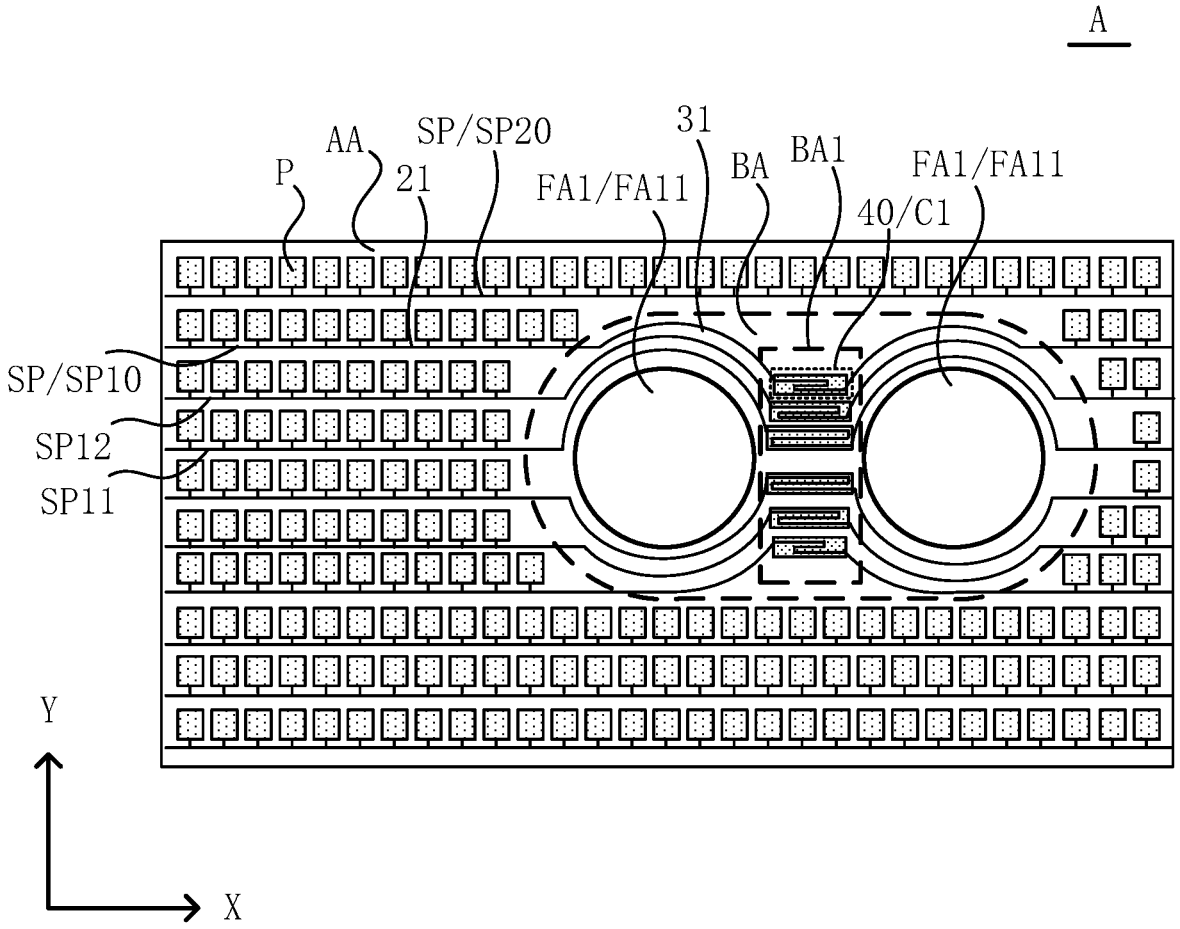
FIG. 6 illustrates another enlarged view of the portion A of the display panel shown in FIG. 1.
Figure 7:
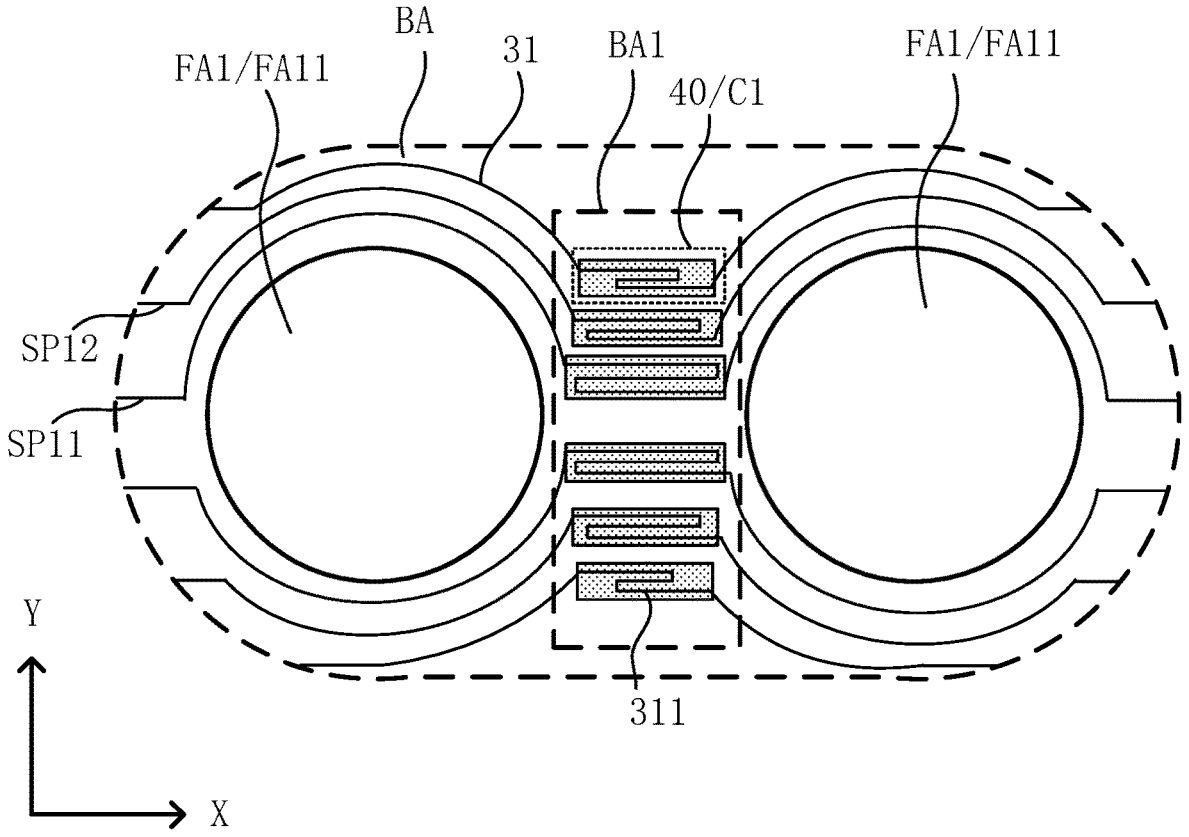
FIG. 7 illustrates an enlarged view of a first non-display area in the display panel shown in FIG. 6.

FIG. 6 illustrates another enlarged view of the portion A of the display panel shown in FIG. 1. FIG. 7 illustrates an enlarged view of a first non-display area in the display panel shown in FIG. 6. Referring to FIG. 1, FIG. 3A, FIG. 3B, FIG. 6 and FIG. 7, in some optional embodiments, the display area AA includes a plurality of subpixels P arranged in an array. A subpixel of the plurality of subpixels P includes a pixel driving circuit 10 and a light emitting element 20 electrically connected to the pixel driving circuit 10.

A first drive signal line SP10 includes a first sub-drive signal line SP11 and a second sub-drive signal line SP12. Number of subpixels P electrically connected to first sub-drive signal lines SP11 is smaller than number of subpixels P electrically connected to second sub-drive signal lines SP12. A capacitance value of a first capacitor C1 electrically connected to the first sub-drive signal line SP11 is greater than a capacitance value of a first capacitor C1 electrically connected to the second sub-drive signal line SP12. Different degrees of load compensation can be performed on the first sub-drive signal lines SP11 and the second sub-drive signal lines SP12, to reduce a load difference caused by a difference between number of subpixels P electrically connected to the first sub-drive signal lines SP11 and number of subpixels P electrically connected to the second sub-drive signal lines SP12, thereby alleviating a difference between a writing time of data signals in pixel driving circuits 10 electrically connected to the first sub drive signal line SP11 and a writing time of data signals in pixel driving circuits 10 electrically connected to the second sub drive signal line SP12, and improving display uniformity of the display panel.

Specifically, a first drive signal line SP10 includes a first sub-drive signal line SP11 and a second sub-drive signal line SP12. Number of subpixels P electrically connected to first sub-drive signal lines SP11 is smaller than number of subpixels P electrically connected to second sub-drive signal lines SP12. Therefore, if the first sub-drive signal lines SP11 and the second sub-drive signal lines SP12 are not electrically connected to the compensation parts 40, a load difference between the first sub-drive signal lines SP11 and the normal drive signal lines SP20 is larger than a load difference between the second sub-drive signal lines SP12 and the normal drive signal lines SP20. Accordingly, a capacitance value of first capacitors C1 electrically connected to the first sub-drive signal lines SP11 is set to be greater than a capacitance value of first capacitors C1 electrically connected to the second sub-drive signal lines SP12, thereby reducing a difference between the load difference between the first sub-drive signal lines SP11 and the regular drive signal lines SP20 and the load difference between the second sub-drive signal lines SP12 and the regular drive signal lines SP20.

It should be noted that one embodiment exemplarily illustrates that a first drive signal line SP10 includes a first sub-drive signal line SP11 and a second sub-drive signal line SP12. Number of subpixels P electrically connected to first sub-drive signal lines SP11 is smaller than number of subpixels P electrically connected to second sub-drive signal lines SP12, so that the capacitance value of the first capacitors C1 electrically connected to the first sub-drive signal lines SP11 is greater than the capacitance value of the first capacitors C1 electrically connected to the second sub-drive signal lines SP12. In other embodiments, a first drive signal line SP10 may further include three or more different sub-drive signal lines, and numbers of subpixels P electrically connected to various sub-drive signal lines are different. Accordingly, the smaller number of electrically connected subpixels P, the greater a capacitance value of first capacitors C1 electrically connected to sub-drive signal lines, thereby reducing load differences among drive signal lines SP in the display panel.

Figure 8:
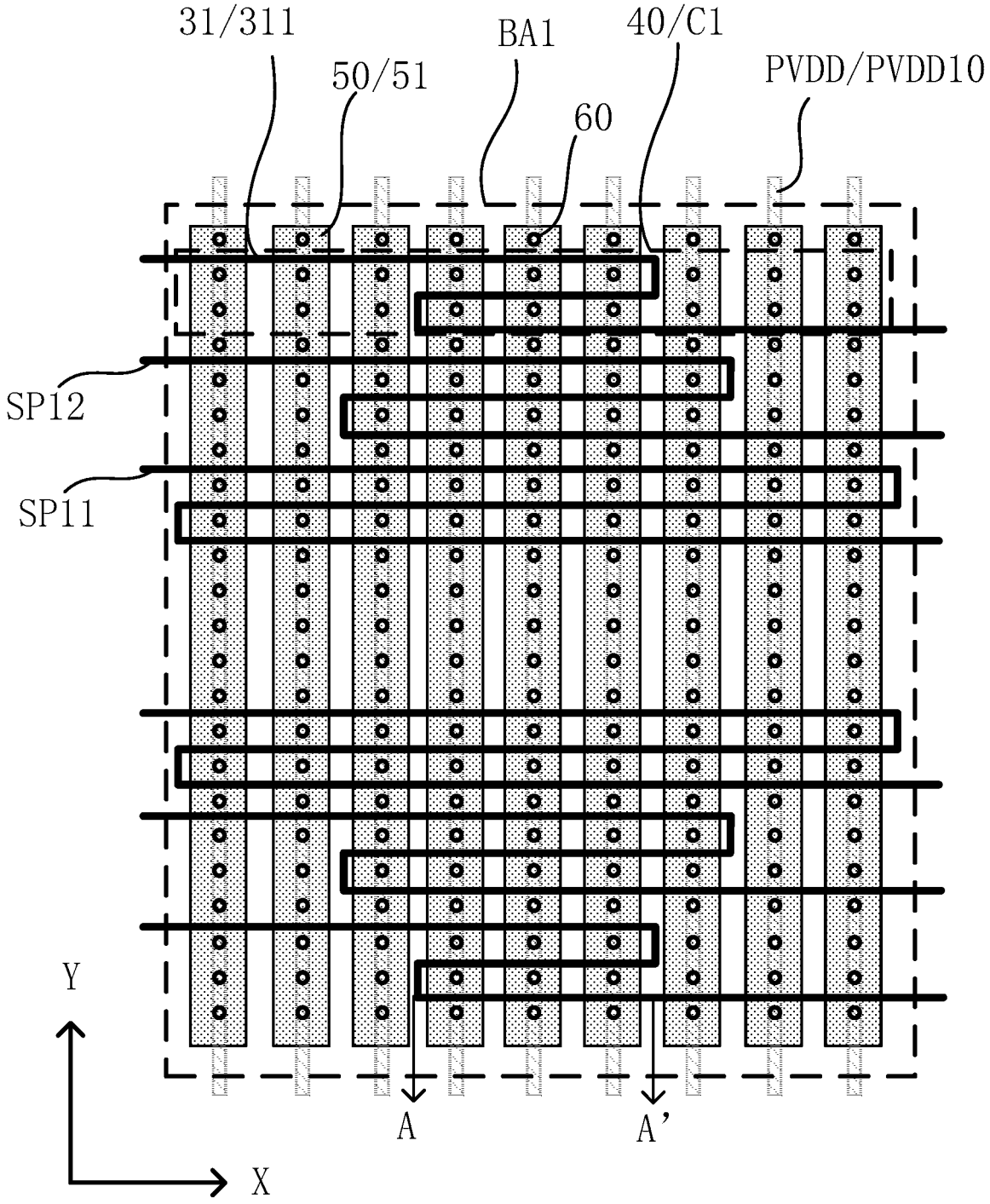
FIG. 8 illustrates a schematic diagram of a compensation area consistent with various embodiments of the present disclosure.
Figure 9:
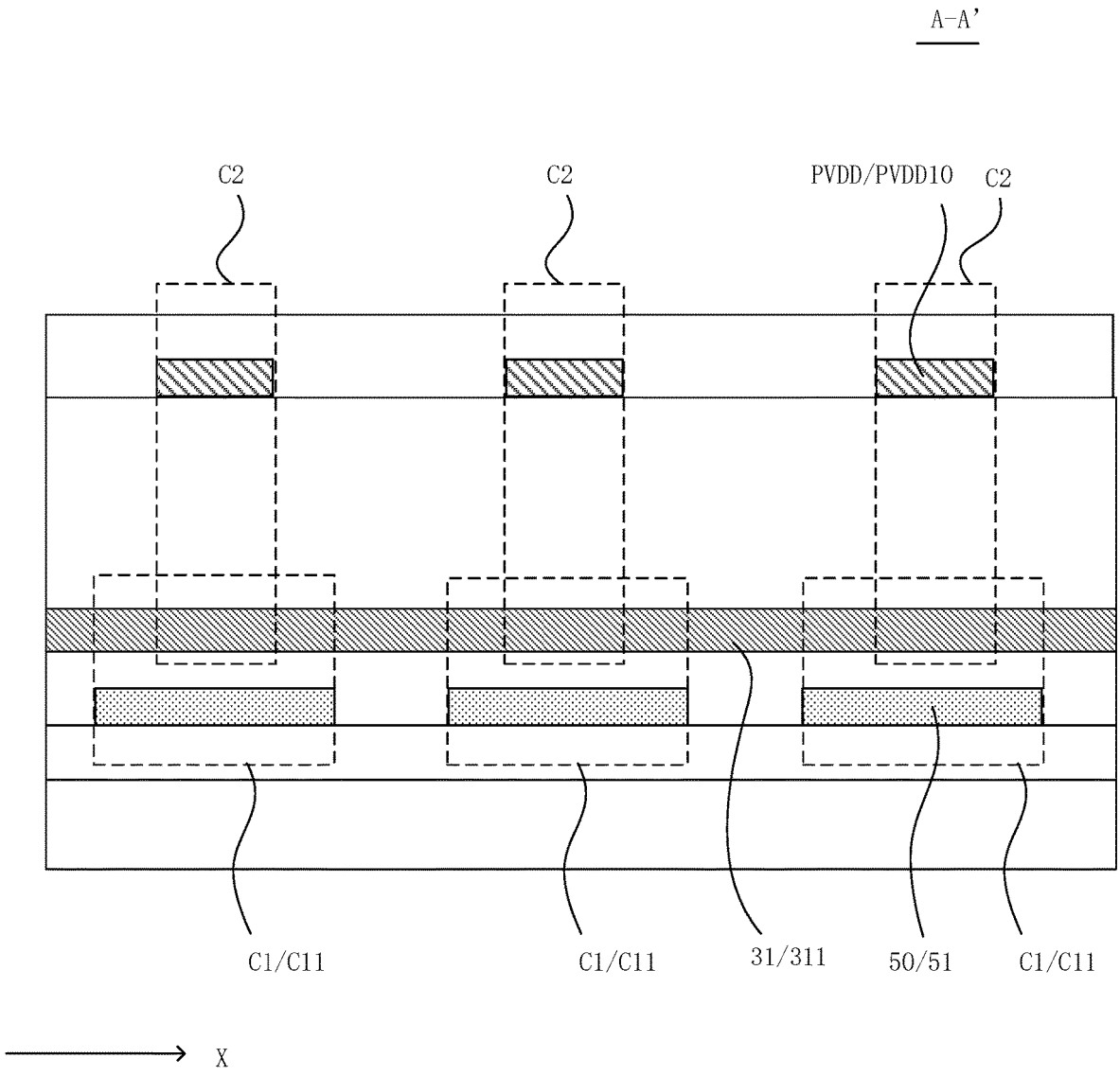
FIG. 9 illustrates a cross-sectional view of the compensation area shown in FIG. 8 along A-A'.

FIG. 8 illustrates a schematic diagram of a compensation area consistent with various embodiments of the present disclosure. FIG. 9 illustrates a cross-sectional view of the compensation area shown in FIG. 8 along A-A'. Referring to FIGS. 6-9, in some optional embodiments, the display panel includes a plurality of first power signal lines PVDD. Part of the plurality of first power signal lines PVDD includes first subsections PVDD10 in the compensation area BA1. That is, part of the plurality of first power signal lines PVDD extends through the compensation area BA1, and the first subsections PVDD10 of the part of the plurality of first power signal lines PVDD are in the compensation area BA1.

The compensation area BA1 includes a plurality of conductive parts 50 electrically connected to the first subsections PVDD10. A conductive part 50 and a first subsection PVDD10 are both insulated from the first connection line segment 31. Part of the conductive part 50 is multiplexed as second plates of the first capacitors C1. Optionally, the conductive part 50 is electrically connected to the first subsection PVDD10 through a via hole 60.

In the direction perpendicular to the plane where the display panel is located, an overlapping portion of a first connection line segment 31 and a conductive part 50 forms a first capacitor C1.

Specifically, a plurality of conductive parts 50 are arranged in the compensation area BA1. A conductive part 50 is electrically connected to a first subsections PVDD10, so that a signal on a first power signal line PVDD can be transmitted to a conductive part 50. In the direction perpendicular to the plane where the display panel is located, a first connection line segment 31 partially overlaps a conductive part 50, so that along the direction perpendicular to the plane of the display panel, an overlapping portion of the first connection line segment 31 and the conductive part 50 forms a first capacitor C1. A portion of the first connection line segment 31 of the overlapping portion is a first plate of the first capacitor C1, and a portion of the conductive part 50 of the overlapping portion is a second plate of the first capacitor C1, so that a first drive signal line SP10 is electrically connected to the first capacitor C1.

Meanwhile, a compensation part 40 may further include second capacitors C2. In the direction perpendicular to the plane where the display panel is located, an overlapping portion of a first power signal line PVDD and a first connection line segment 31 may form a second capacitor C2. A portion of the first connection line segment 31 of the overlapping portion is a first plate of the second capacitor C2, and a portion of the first power signal line PVDD of the overlapping portion is a second plate of the second capacitor C2, so that a first drive signal line SP10 is electrically connected to the second capacitor C2, thereby improving load compensation on the first drive signal line SP10.

Optionally, a conductive part 50 can be arranged on a same layer as a source of a transistor in the display panel, so that along the direction perpendicular to the plane where the display panel is located, a distance between the conductive part 50 and a first connection line segment 31 is much smaller than a distance between a first connection line segment 31 and a first power supply signal line PVDD. That is, along the direction perpendicular to the plane where the display panel is located, the distance between the conductive part 50 and the first connection line segment 31 is relatively small, so that along the direction perpendicular to the plane where the display panel is located, a capacitance value of the first capacitor C1 formed by an overlapping portion of the first connection line segment 31 and the conductive part 50 is relatively large, which is conductive to improving load compensation on a first drive signal line SP10.

Referring to FIGS. 6-9, in some optional embodiments, the first subsections PVDD10 extend along a second direction Y. The first direction X intersects the second direction Y. Optionally, the first direction X is perpendicular to the second direction Y.

A conductive part 50 includes a plurality of conductive line segments 51 extending along the second direction Y, and one conductive line segment 51 is electrically connected to at least one first subsection PVDD10 through the via hole 60, so that signals on the at least one first subsection PVDD10 can be transmitted to the one conductive line segment 51.

A first drive signal line SP10 includes a curved line portion 311, and a portion of the first drive signal line SP10 in the compensation area BA1 is the curved line portion 311.

A first capacitor C1 includes a plurality of first sub-capacitors C11. At each intersection of the curved line portion 311 and a conductive line segment 51, in the direction perpendicular to the plane where the display panel is located, an overlapping portion of the curved line portion 311 and the conductive line segment 51 forms a first sub-capacitor C11.

Number of first sub-capacitors C11 electrically connected to a first sub-drive signal line SP11 is greater than number of first sub-capacitors C11 electrically connected to a second sub-drive signal line SP12.

Specifically, along the direction perpendicular to the plane where the display panel is located, an overlapping portion of the curved line portion 311 and a conductive line segment 51 in a first drive signal line SP10 forms a first sub-capacitor C11. Accordingly, a sum of capacitance values of all first sub-capacitors C11 electrically connected to the first drive signal line SP10 is a capacitance value of the first capacitor C1 electrically connected to the first drive signal line SP10. By increasing a winding length of the curved line portion 311 of the first sub-drive signal line SP11 in the compensation area BA1, along the direction perpendicular to the plane where the display panel is located, the curved line portion 311 in the first sub-drive signal line SP11 overlaps with a larger number of conductive line segments 51, so that number of first sub-capacitors C11 electrically connected to the first sub-drive signal line SP11 is greater than number of first sub-capacitors C11 electrically connected to the second sub-drive signal line SP12, thereby realizing that the capacitance value of the first capacitor C1 electrically connected to the first sub-drive signal line SP11 is greater than the capacitance value of the first capacitor C1 electrically connected to the second sub-drive signal line SP12.

Optionally, the winding length of the curved line portion 311 of each first drive signal line SP10 in the compensation area BA1 can be adjusted according to a compensation amount that needs to be performed for load compensation on each first drive signal line SP10, so that number of first sub-capacitors C11 electrically connected to each first drive signal line SP10 can be adjusted, thereby adjusting a capacitance value of a first capacitor C1 electrically connected to each first drive signal line SP10.

Referring to FIGS. 6-9, in some optional embodiments, a width of a conductive line segment 51 in the first direction X is greater than a width of a first subsection PVDD10 in the first direction X. By increasing the width of the conductive line segment 51 in the first direction X, an overlapping portion of the curved line portion 311 and the conductive line segment 51 in the direction perpendicular to the plane where the display panel is located can be increased. Therefore, along the direction perpendicular to the plane where the display panel is located, a capacitance value of a first sub-capacitor C11 formed by an overlapping portion of the curved line portion 311 and the conductive line segment 51 is relatively large, which is conductive to increasing a load compensation on a first drive signal line SP10.

Figure 10:
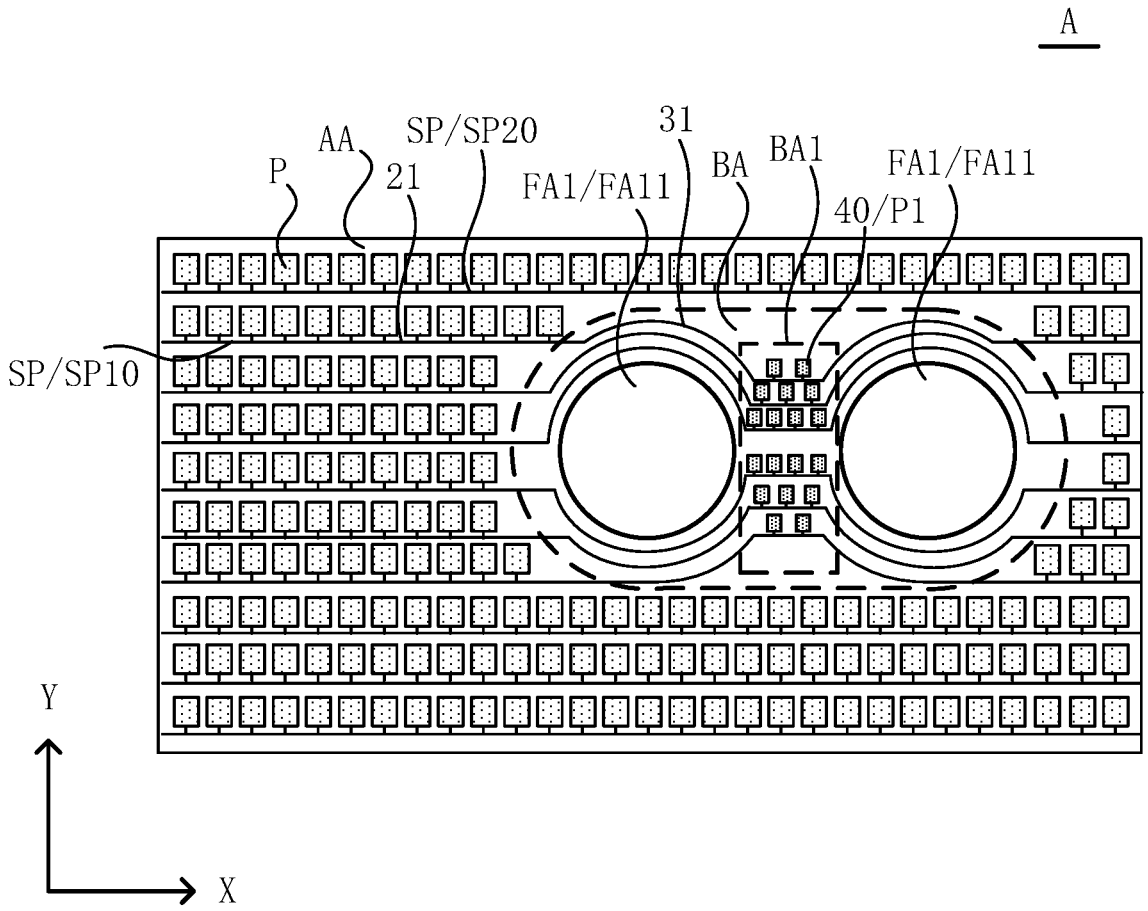
FIG. 10 illustrates another enlarged view of the portion A of the display panel shown in FIG. 1.
Figure 11:
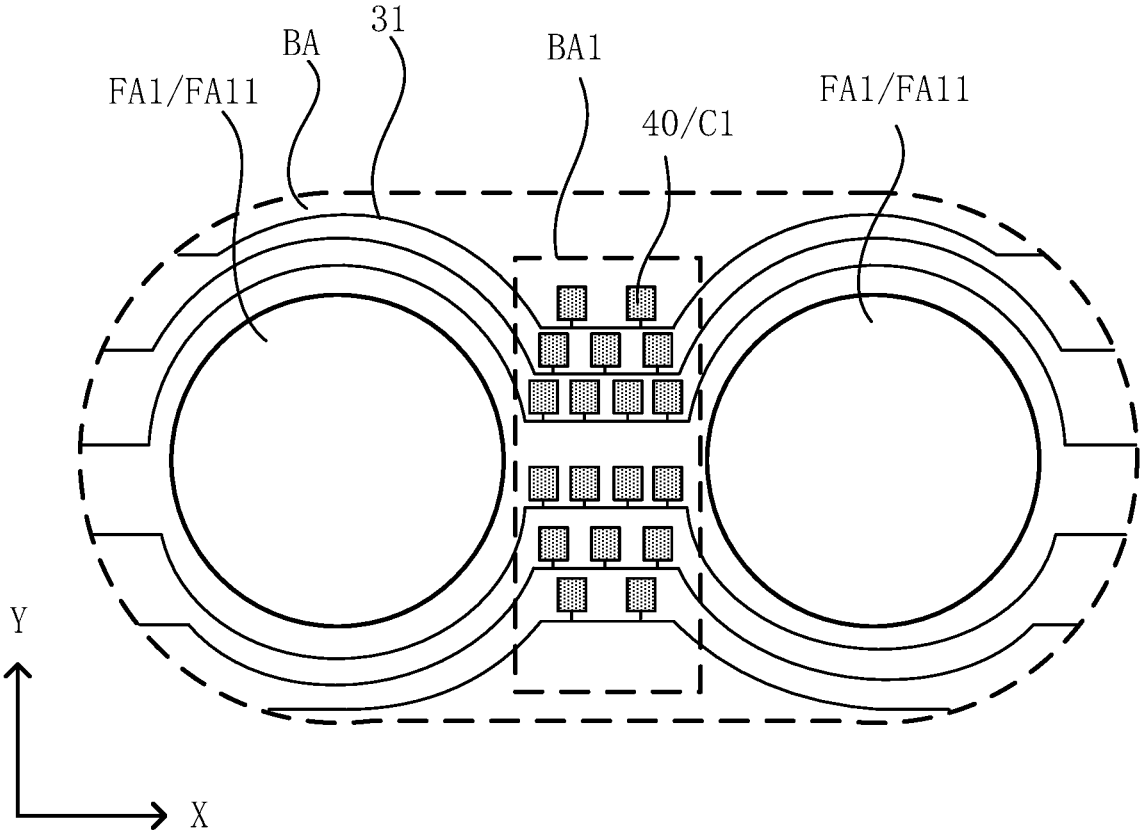
FIG. 11 illustrates an enlarged view of a first non-display area in the display panel shown in FIG. 10.

FIG. 10 illustrates another enlarged view of the portion A of the display panel shown in FIG. 1. FIG. 11 illustrates an enlarged view of a first non-display area in the display panel shown in FIG. 10. Referring to FIGS. 1, 3A, 10 and 11, in some optional embodiments, the compensation part 40 includes dummy subpixels P1.

Specifically, a plurality of dummy subpixels P1 can be arranged in the compensation area BA1, and a dummy subpixel P1 is not used for display. The first connection line segment 31 in the first drive signal line SP10 can be electrically connected to the dummy subpixel P1, so that a load on the first drive signal line SP10 can be increased.

Referring to FIG. 1, FIG. 3A, FIG. 10 and FIG. 11, in some optional embodiments, the display area AA includes a plurality of subpixels P arranged in an array, and a subpixel of the plurality of subpixels P include a pixel driving circuit 10 and a light-emitting element 20 electrically connected to the pixel driving circuit 10.

A first drive signal line SP10 includes a first sub-drive signal line SP11 and a second sub-drive signal line SP12. Number of subpixels P electrically connected to the first sub-drive signal line SP11 is smaller than number of subpixels P electrically connected to the second sub-drive signal line SP12, and the number of dummy subpixels P1 electrically connected to the first sub-drive signal line SP11 is greater than number of dummy subpixels P1 electrically connected to the second sub-drive signal line SP12. Different degrees of load compensation can be performed on the first sub-drive signal line SP11 and the second sub-drive signal line SP12, thereby reducing a load difference due to a difference between number of subpixels P electrically connected to the first sub-drive signal line SP11 and number of subpixels P electrically connected to the second sub-drive signal line SP12, thereby alleviating a difference between a writing time of data signals in pixel driving circuits 10 electrically connected to the first sub drive signal line SP11 and a writing time of data signals in pixel driving circuits 10 electrically connected to the second sub drive signal line SP12, and improving display uniformity of the display panel.

Specifically, a first drive signal line SP10 includes a first sub-drive signal line SP11 and a second sub-drive signal line SP12. Number of subpixels P electrically connected to the first sub-drive signal line SP11 is smaller than number of subpixels P electrically connected to the second sub-drive signal line SP12. Therefore, if the first sub-drive signal line SP11 and the second sub-drive signal line SP12 are not electrically connected to the compensation parts 40, a load difference between the first sub-drive signal line SP11 and the normal drive signal line SP20 is larger than a load difference between the second sub-drive signal line SP12 and the normal drive signal line SP20. Accordingly, number of dummy subpixels P1 electrically connected to a first sub-drive signal line SP11 is set to be greater than number of dummy subpixels P1 electrically connected to a second sub-drive signal line SP12, thereby reducing a difference between a load difference between the first sub-drive signal line SP11 and a regular drive signal line SP20 and a load difference between the second sub-drive signal line SP12 and a regular drive signal line SP20.

It should be noted that one embodiment exemplarily illustrates that the first drive signal line SP10 includes a first sub-drive signal line SP11 and a second sub-drive signal line SP12. Number of subpixels P electrically connected to the first sub-drive signal line SP11 is smaller than number of subpixels P electrically connected to the second sub-drive signal line SP12, so that number of dummy subpixels P1 electrically connected to the first sub-drive signal line SP11 is greater than number of dummy subpixels P1 electrically connected to the second sub-drive signal line SP12. In other embodiments, the first drive signal line SP10 may further include three or more different sub-drive signal lines, and numbers of the subpixels P electrically connected to various sub-drive signal lines are different. Accordingly, the smaller number of electrically connected subpixels P, the greater number of dummy subpixels P1 electrically connected to the sub-drive signal line, thereby reducing load differences among drive signal lines SP in the display panel.

Figure 12:
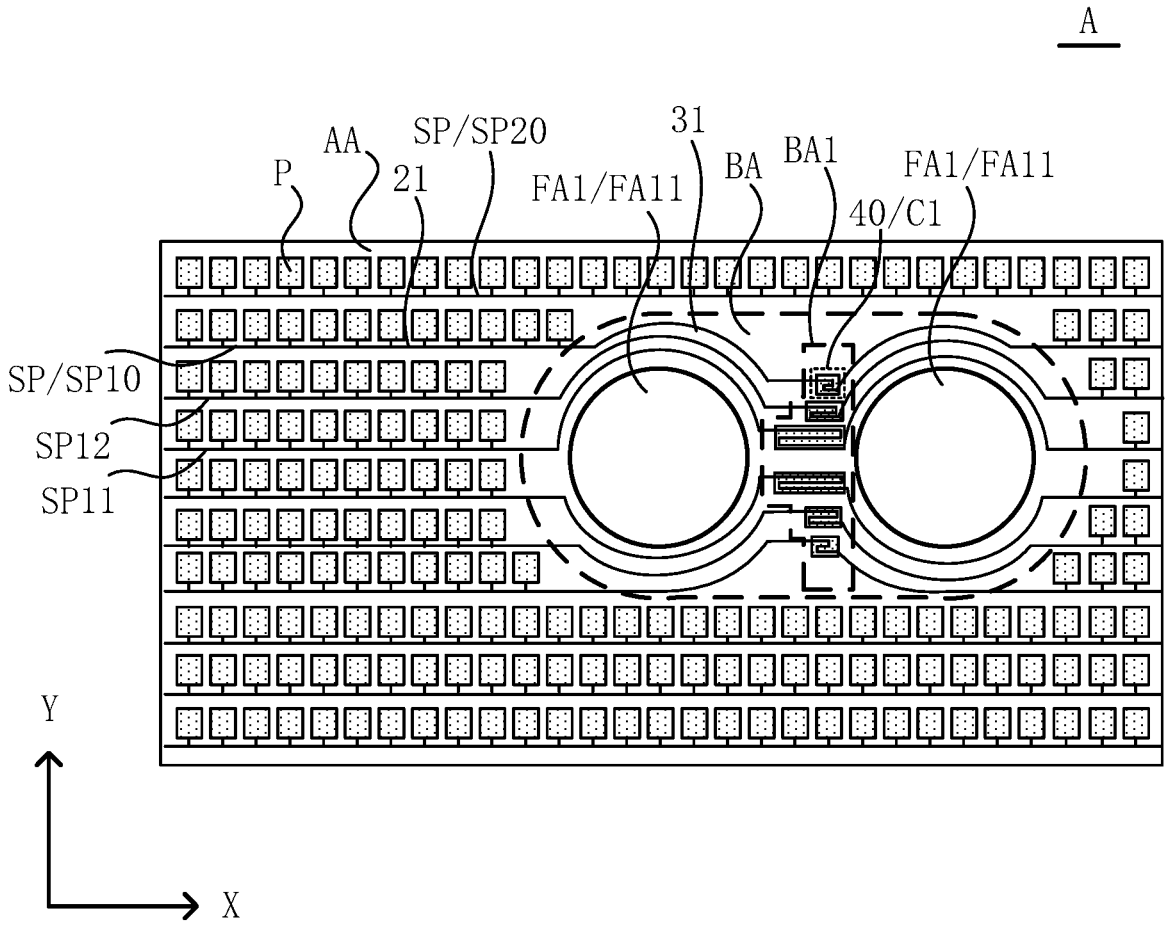
FIG. 12 illustrates another enlarged view of the portion A of the display panel shown in FIG. 1.
Figure 13:
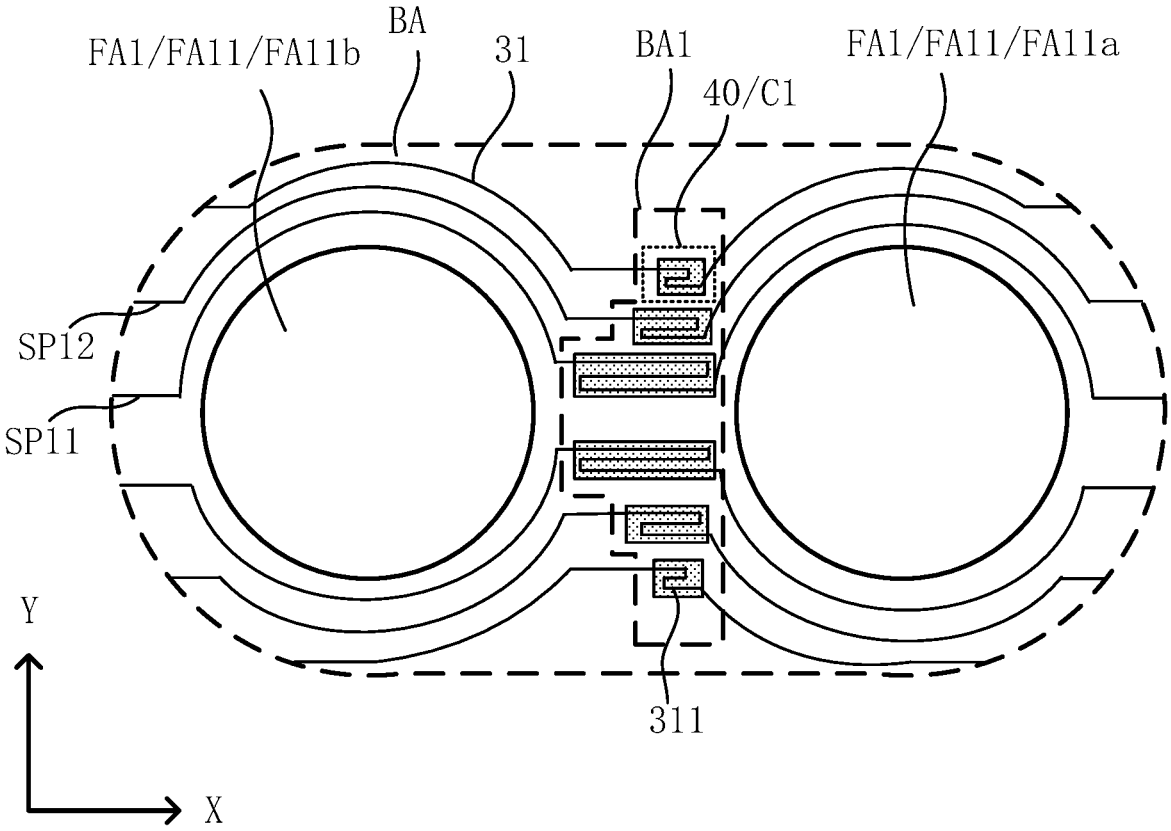
FIG. 13 illustrates an enlarged view of a first non-display area in the display panel shown in FIG. 12.

FIG. 12 illustrates another enlarged view of the portion A of the display panel shown in FIG. 1. FIG. 13 illustrates an enlarged view of a first non-display area in the display panel shown in FIG. 12. Referring to FIGS. 12 and 13, in some optional embodiments, the compensation area BA1 at least partially surrounds any one of adjacent first light transmission areas FA11, and a distance between the compensation area BA1 and a first light-transmitting area FA11 in the first direction X is smaller than a distance between the compensation area BA1 and another first light-transmitting area FA11 adjacent thereto in the first direction X.

Exemplarily, the compensation area BA1 is arranged between the adjacent first light-transmitting areas FA11*a* and FA11*b* along the first direction X. A distance between the compensation area BA1 and the first light transmission area FA11*b* is larger than a distance between the compensation area BA1 and the first light transmission area FA11*a*, so that the compensation area BA1 is partially arranged around the first light transmission area FA11*a*. Accordingly, the compensation parts 40 in the compensation area BA1 are arranged around the first light-transmitting area FA11*a* to effectively improves a light transmittance of an area between the first light transmission area FA11*a* and the first light transmission area FA11*b*, and an electronic photosensitive device can be arranged in the area between the first light transmission area FA11*a* and the first light transmission area FA11*b*.

Figure 14:
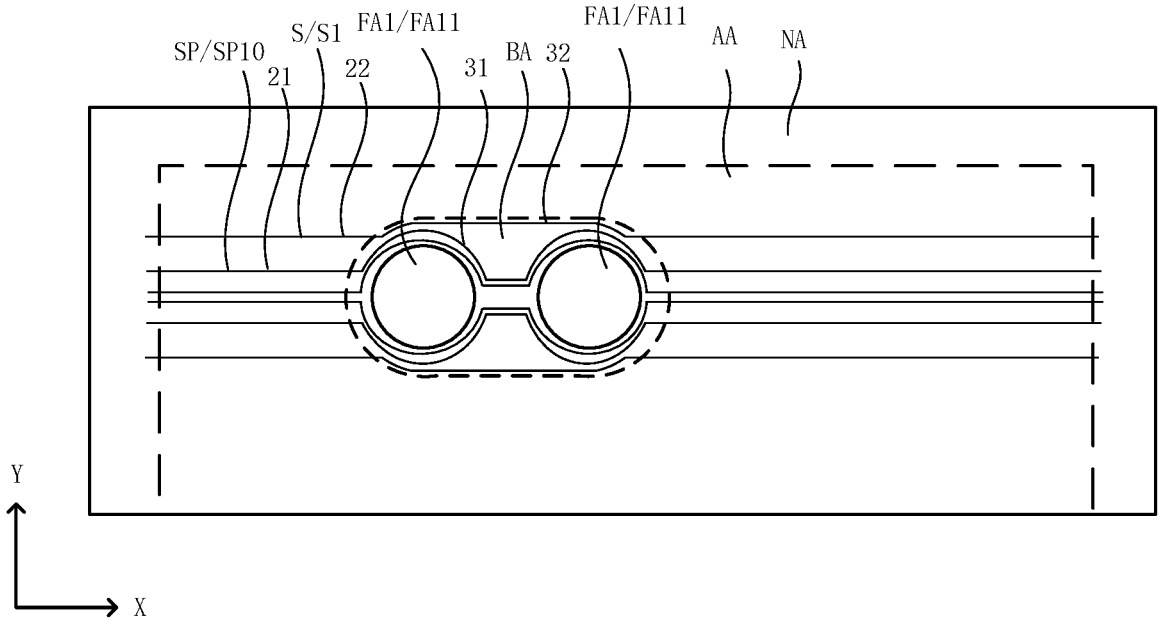
FIG. 14 illustrates a partial plan view of another display panel consistent with various embodiments of the present disclosure.

FIG. 14 illustrates a partial plan view of another display panel consistent with various embodiments of the present disclosure. Referring to FIG. 14, in some optional embodiments, the display panel further includes control signal lines S electrically connected to the pixel driving circuits.

The control signal lines S include a first signal line S1. The first signal line S1 includes a second line segment 22 in the display area AA and a second connection line segment 32 located in the first non-display area BA and connected to the second line segment 22. The second line segment 22 is on a side of the first light-transmitting group FA1 along the first direction X. Due to an arrangement of the first light-transmitting group FA1 and the first non-display area BA, there is at least one first signal line S1 in the display panel. The second line segment 22 of the first signal line S1 is in the display area AA, and the second connection line segment 32 connected to the second line segment 22 is in the first non-display area BA, to realize transmissions of signals on the first signal line S1.

The second connection line segment 32 extends along an extending direction of an edge of the first non-display area BA.

Specifically, the control signal lines S are electrically connected to control terminals of other modules in the pixel driving circuits except the data writing modules, so that an influence of a signal of the control signal line S on a writing time of data signals in the pixel driving circuits is negligible. The second connection line segment 32 of the first signal line S1 may extend along an extending direction of an edge of the first non-display area BA, i.e., the second connection line segment 32 in the first signal line S1 is not wound in an area between two adjacent first light-transmitting areas FA11 in the first light-transmitting group FA1, which is convenient for the first connection line segment 31 in the first drive signal line SP10 to be wounded in an area between two adjacent first light-transmitting areas FA11 in the first light-transmitting group FA1.

It should be noted that, to clearly illustrate an arrangement of the control signal lines S and the first drive signal lines SP10, FIG. 14 only exemplarily illustrates that the display panel includes two control signal lines S and four first drive signal lines SP10. In an actual product provided by the present disclosure, the display panel may include other numbers of control signal lines S and first drive signal lines SP10, which are not specifically limited herein, and can be set according to actual production requirements.

Figure 15:
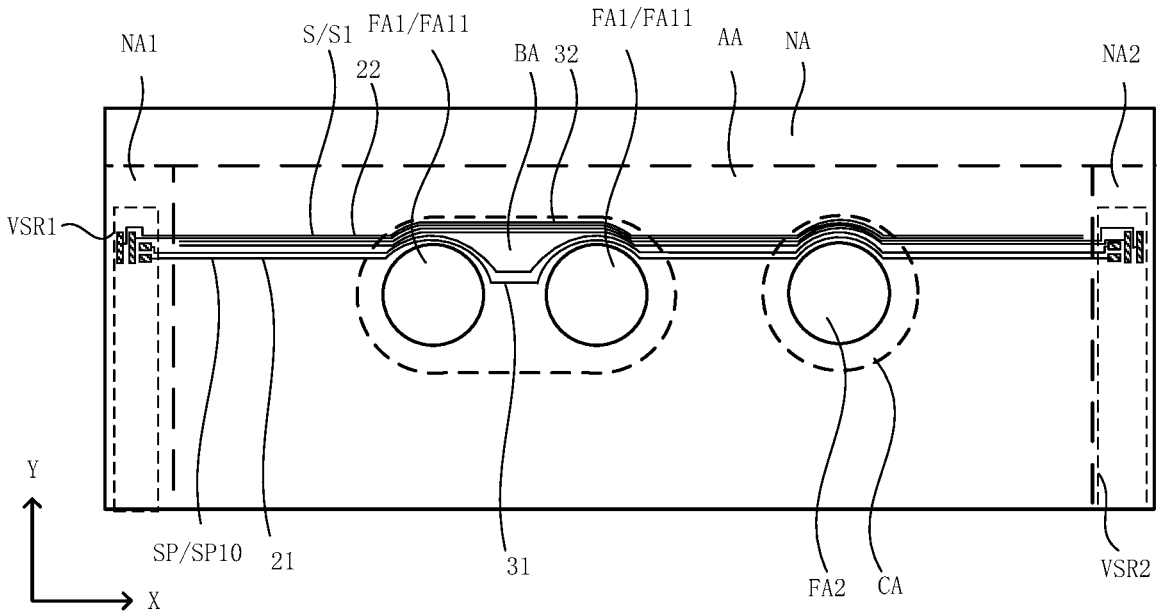
FIG. 15 illustrates a partial plan view of another display panel consistent with various embodiments of the present disclosure.

FIG. 15 illustrates a partial plan view of another display panel consistent with various embodiments of the present disclosure. Referring to FIG. 15, in some optional embodiments, the display panel further includes a frame area N1 surrounding the display area AA and the frame area N1 is not used for display. A frame area NA includes a first frame area NA1 and a second frame area NA2, and the first frame area NA1 and the second frame area NA2 are oppositely disposed along the first direction X. The first frame area NA1 and the second frame area NA2 are respectively disposed on two sides of the display area AA along the first direction X.

The display panel further includes a first shift register VSR1 and a second shift register VSR2. The first shift register VSR1 is in the first frame area NA1, and the second shift register VSR2 is in the second frame area NA2.

The drive signal lines SP are electrically connected to the first shift register VSR1 and the second shift register VSR2, and both the first shift register VSR1 and the second shift register VSR2 are used to transmit electrical signals to the drive signal lines SP. Since the drive signal lines SP are electrically connected to control terminals of the data writing modules in the pixel driving circuits, the data writing modules are controlled to be turned on or off by signals on the drive signal lines SP, so that a writing time of data signals in the pixel driving circuits can be controlled. Using the first shift register VSR1 and the second shift register VSR2 to transmit electrical signals to the drive signal lines SP can effectively alleviate a delay phenomenon of signals transmitted on the drive signal lines SP, thereby reducing delays of data signals and avoiding an incomplete writing of the data signals. Especially when the display panel is a high-resolution display panel, an incomplete writing of data signals can be avoided, which is conductive to improving display uniformity of the display panel.

The display panel further includes control signal lines S electrically connected to the pixel driving circuits, and the control signal lines S are electrically connected to control terminals of other modules in the pixel driving circuits except the data writing modules, so that an influence of signals on the control signal lines S on the data signals in the pixel driving circuits can be neglected, and the control signal lines S can be driven by one side, i.e., the control signal lines S are electrically connected to only one shift register. Part of the control signal lines S in the display panel can be electrically connected to the first shift register VSR1, and a remaining part of the control signal lines S are electrically connected to the second shift register VSR2, which is conductive to reducing volumes of the first shift register VSR1 and the second shift register VSR2, and is conductive to reducing sizes of the first frame area NA1 and the second frame area NA2, to realize a narrow frame.

It should be noted that, FIG. 15 exemplarily illustrates that, when the display panel further includes a second light-transmitting area FA2 and a second non-display area CA, the drive signal lines SP corresponding to the first light-transmitting group FA1 can be driven by two sides, and the drive signal lines SP are set for load compensation in areas between two adjacent first light-transmitting areas FA11 in the first light-transmitting group FA1. In other embodiments, the drive signal lines SP extending through areas between the first light-transmitting group FA1 and the second light-transmitting area FA2 can be driven by one side and can be partially electrically connected to the first shift register, and partially electrically connected to the second shift register. Accordingly, the drive signal lines SP extending through the first non-display area BA and not extending through the second non-display area CA are configured for load compensation in areas between two adjacent first light-transmitting areas FA11 in the first light-transmitting group FA1. The drive signal lines SP extending through the second non-display area CA and not extending through the first non-display area BA may not be set for load compensation. In other embodiments, part of the drive signal lines SP extending through the region between the first light-transmitting group FA1 and the second light-transmitting area FA2 can be driven by one side, and are electrically connected to the first shift register, so that the part of the drive signal line SP extends through the first non-display area BA and can be set for load compensation in areas between the two adjacent first light-transmitting areas FA11 in the first light-transmitting group FA1.

Referring to FIG. 3A and FIG. 3B, in some optional embodiments, the display panel further includes control signal lines S electrically connected to the pixel driving circuits 10.

The pixel driving circuit further includes a driving transistor T3, a compensation module 12, a first reset module 13, a second reset module 14, a first lighting control module 15, a second lighting control module 16 and a voltage adjustment module 17. The drive transistor T3 is configured to provide a light-emitting drive current for the light-emitting element 20, a gate of the drive transistor T3 is electrically connected to a first node N1, a first electrode of the drive transistor T3 is electrically connected to a second node N2, and a second electrode of the driving transistor T3 is electrically connected to a third node N3. The data writing module 11 is electrically connected to the second node N2, and the data writing module 11 is configured to input data signals to the second node N2. The compensation module 12 is connected to the first node N1 and the second node N2, and the compensation module 12 is configured to capture a threshold voltage of the driving transistor T3. The first reset module 13 is electrically connected to the first node N1, and the first reset module 13 is used to reset the signal of the first node N1. The second reset module 14 is electrically connected to a fourth node N4, and the second reset module 14 is configured to reset signals of the fourth node N4. The first lighting control module 15 is electrically connected to the second node N2, the second lighting control module 16 is electrically connected to the third node N3 and the fourth node N4, and the first light-emitting control module 15 and the second light-emitting control module 16 are configured to control a light-emitting driving current provided by the driving transistor T3 to be transmitted to the light-emitting element 20. The voltage adjustment module 17 is electrically connected to the second node N2, and the voltage adjustment module 17 is configured to adjust a bias state of the driving transistor T3.

The control signal lines S include a first control signal line S11, a second control signal line S12, a third control signal line S13 and a light-emitting control signal line EM. A control terminal of the compensation module 12 is electrically connected to the first control signal line S11, a control terminal of the first reset module 13 is electrically connected to the second control signal line S12, and a control terminal of the second reset module 14 is electrically connected to the third control signal line S13. Control terminals of the first lighting control module 15 and the second lighting control module 16 are both electrically connected to the light-emitting control signal line EM. A control terminal of the voltage adjustment module 17 is electrically connected to the third control signal line S13.

It should be noted that the embodiment exemplarily illustrates that the pixel driving circuit further includes a driving transistor T3, a compensation module 12, a first reset module 13, a second reset module 14, a first lighting control module 15, and a voltage regulator module 17. Accordingly, the control signal lines S include first control signal lines S11, second control signal lines S12, third control signal lines S13 and light-emitting control signal lines EM. In other embodiments, the pixel driving circuit may further include working modules having other functions, and the control signal lines S may further include other control signal lines, which is not detailed herein.

It should be noted that FIG. 3A exemplarily illustrates an 8T1C pixel driving circuit diagram. FIG. 3B exemplarily shows a driving sequence of the pixel driving circuit of 8T1C shown in FIG. 3A. In other embodiments, the pixel driving circuit of 8T1C shown in FIG. 3A may also adopt other timings. The pixel driving circuit may also adopt other circuits, which is not detailed herein.

Figure 16:
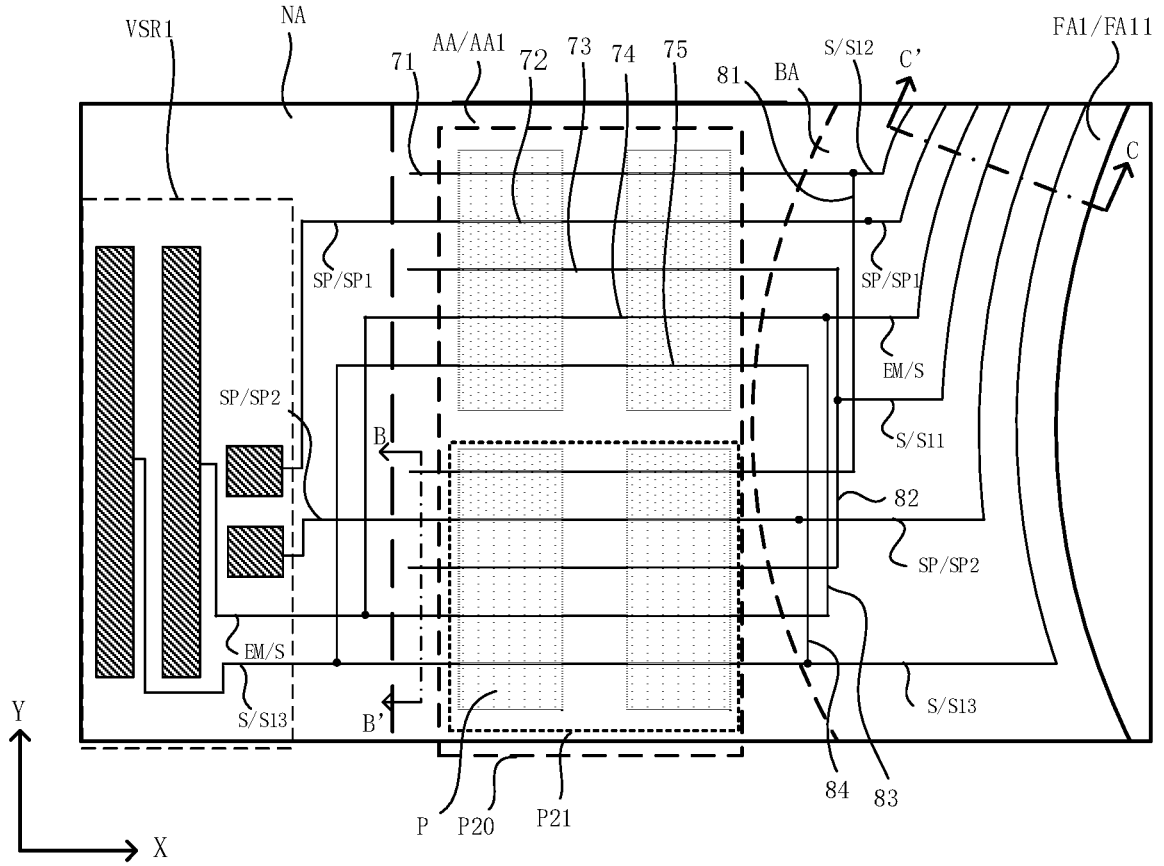
FIG. 16 illustrates a partial plan view of another display panel consistent with various embodiments of the present disclosure.

FIG. 16 illustrates a partial plan view of another display panel consistent with various embodiments of the present disclosure. Referring to FIGS. 3A and 16, in some optional embodiments, the display area AA includes at least one first display area AA1 on a side of the first light-transmitting area FA11 along the first direction X.

The first display area AA1 includes a plurality of pixel row groups P20, one pixel row group P20 includes two pixel rows P21. A pixel row P21 includes a plurality of subpixels P arranged along the first direction X, and a subpixel P includes a pixel driving circuit 10 and a light emitting element 20 electrically connected to the pixel driving circuit 10.

Each pixel driving circuit 10 in a same pixel row P21, is electrically connected to a same drive control signal line SP and pixel driving circuits 10 in different pixel rows P21 are electrically connected to different drive control signal lines SP. That is, pixel driving circuits 10 in each pixel row P21 are electrically connected to different drive control signal lines SP, and one drive control signal line SP only provides signals to the pixel driving circuits 10 in one pixel row P21. Since the drive signal lines SP are electrically connected to control terminals of data writing modules 11 in the pixel driving circuits 10, the data writing modules 11 are controlled to be turned on or off by signals on the drive signal lines SP, so that a writing time of data signals in the pixel driving circuits 10 can be controlled. Using one drive control signal line SP to only provide signals to the pixel driving circuits 10 in one pixel row P21 can prevent drive control signal lines SP from being electrically connected to too many pixel driving circuits 10 and can effectively alleviate a delay phenomenon of signals transmitted on the drive signal lines SP, so that a delay phenomenon of data signals can be reduced, and an incomplete writing of data signals can be avoided.

In a same pixel row group P20, each pixel driving circuit 10 is electrically connected to a same first control signal line S11, each pixel driving circuit 10 is electrically connected to a same second control signal line S12, each pixel driving circuit 10 is electrically connected to a same third control signal line S13, and each pixel driving circuit 10 is electrically connected to a same light-emitting control signal line EM. That is, one first control signal line S11 can provide signals with the pixel driving circuits 10 in two pixel rows P21, one second control signal line S12 can provide signals with the pixel driving circuits 10 in two pixel rows P21, one third control signal line S13 can provide signals with the pixel driving circuits 10 in two pixel rows P21, and one light-emitting control signal line EM can provide signals with the pixel driving circuits 10 in the two pixel rows P21. The first control signal lines S11, the second control signal lines S12, the third control signal lines S13, and the light-emitting control signal lines EM are electrically connected to control terminals of other modules in the pixel driving circuit 10 except the data writing modules 11, so that an influence of signals on the first control signal lines S11, the second control signal lines S12, the third control signal lines S13 and the light-emitting control signal lines EM on data signals in the pixel driving circuits 10 is negligible. Therefore, one first control signal line S11 can be used to be electrically connected to the pixel driving circuits 10 in two pixel rows P21, one second control signal line S12 can be electrically connected to the pixel driving circuits 10 in two pixel rows P21, and one third control signal line S13 can be used to be electrically connected to pixel driving circuits 10 in the two pixel rows P21, and one light-emitting control signal line EM can be used to be electrically connected to the pixel driving circuits 10 in two pixel rows P21, thereby effectively reducing number of control signal lines S in the first display area AA1 arranged adjacent to the first light-transmitting area FA11, and reducing number of control signal lines S in the first non-display area BA, which is conductive to reducing a size of the first non-display area BA.

It should be noted that, in order to clearly illustrate an arrangement of the drive signal lines SP, the first control signal lines S11, the second control signal lines S12, the third control signal lines S13 and the light-emitting control signal lines EM in the first display area AA1, FIG. 16 does not illustrate an arrangement of subpixels in the first display area AA1 of the display panel, nor does it illustrate a specific connection method. A connection among the pixel driving circuits 10 in the subpixels P and the drive signal lines SP, the first control signal lines S11, the second control signal lines S12, the third control signal lines S13 and the light-emitting control signal lines EM can be referred to FIG. 3A and an arrangement of the subpixels P in the first display area AA1 of the display panel can be referred to FIG. 2.

Referring to FIGS. 3A, 3B and 16, in some optional embodiments, one second control signal line S12 is electrically connected to two first signal transmission lines 71 in the first display area AA1 through a first connection line 81. The two first signal transmission lines 71 are respectively electrically connected to the pixel driving circuits 10 in different pixel rows P21 and can provide signals to each pixel driving circuit 10 in a same pixel row group P20 corresponding to a same second control signal line S12 through the same second control signal line S12.

One drive signal line SP is electrically connected to one second signal transmission line 72 in the first display area AA1, and signals can be provided to each pixel driving circuit 10 in a same pixel row P21 corresponding to a same drive signal line SP through the same drive signal line SP.

One first control signal line S11 is electrically connected to two third signal transmission lines 73 in the first display AA1 through a second connection line 82. The two third signal transmission lines 73 are respectively electrically connected to the pixel driving circuits 10 in different pixel rows P21. Signals can be provided to each pixel driving circuit 10 in a same pixel row group P20 corresponding to a same first control signal line S11 through the same first control signal line S11.

One light-emitting control signal line EM is electrically connected to two fourth signal transmission lines 74 in the first display area AA1 through a third connection line 83. The two fourth signal transmission lines 74 are respectively electrically connected to the pixel driving circuits 10 in different pixel rows P21. Signals can be provided to each pixel driving circuit 10 in a same pixel row group P20 corresponding to a same light-emitting control signal line EM through the same light-emitting control signal line EM.

One third control signal line S13 is electrically connected to two fifth signal transmission lines 75 in the first display area AA1 through a fourth connection line 84. The two fifth signal transmission lines 75 are respectively electrically connected to the pixel driving circuits 10 in different pixel rows P21. Signals can be provided to each pixel driving circuit 10 in a same pixel row group P20 corresponding to a same third control signal line S13 through the same third control signal line S13.

Along the second direction Y, the first signal transmission lines 71 to the fifth signal transmission lines 75 electrically connected to the pixel driving circuits 10 in a same pixel row P21 are arranged in sequence. The first direction X intersects the second direction Y. Optionally, the first direction X is perpendicular to the second direction Y.

In a same pixel row group P20, the two pixel rows P21 are an N-th row pixel row and an (N+1)-th row pixel row respectively, N≥1, and N is a positive integer. A drive signal line SP electrically connected to each pixel driving circuit 10 in the N-th pixel row is a second drive signal line SP1. A drive signal line SP electrically connected to each pixel driving circuit 10 in the (N+1)-th pixel row is a third drive signal line SP2.

In the first non-display area BA, along the second direction Y, the second control signal line S12, the second drive signal line SP1, the light emitting control signal line EM, the first control signal line S11, the third drive signal line SP2, and the third control signal line S13 that are electrically connected to the pixel driving circuits 10 in a same pixel row group P20 are arranged in sequence. Along the second direction Y, signal interferences among the second control signal line S12, the second drive signal line SP1, the light-emitting control signal line EM, the first control signal line S11, the third drive signal line SP2, and the third control signal line S13 that are electrically connected to the pixel driving circuits 10 in a same pixel row group P20 can be reduced.

Exemplarily, in a low frequency process, neither a light-emitting control signal line EM nor a third control signal line S13 is down converted. A relatively large distance between the light-emitting control signal line EM and the third control signal line S13 can avoid a signal crosstalk between the light-emitting control signal line EM and the third control signal line S13 when a frame is held at a low frequency.

The drive signal line SP directly affects a writing of the data signal in the pixel driving circuit 10. When a high-level pulse appears on a signal on the drive signal line SP, signals on signal lines around the drive signal line SP avoid rising or falling edges as much as possible, to avoid crosstalk with the signal on the drive signal line SP. A relatively large distance between the second drive signal line SP1 and the third drive signal line SP2 can avoid the above problems.

Since a pixel driving circuit 10 of 8T1C must have five scanning signals per row, if one shift register circuit is arranged for each scan signal and is driven by two sides, five shift register circuits need to be arranged on a single-side frame, and a narrow frame design cannot be realized. Therefore, in the present disclosure, the control signal lines S other than the drive signal lines SP can be driven by one side, and a one-drive-two design can be adopted, so that a width of a frame area can be reduced. Therefore, high-level pulses of signals on the first control signal lines S11 needs to cover pulses on the pixel driving circuits 10 in two rows, to realize the one-drive-two design. When the first control signal lines S11 are turned on, the pixel driving circuits 10 of the two rows are turned on in turn. If the first control signal lines S11 are turned off immediately after the pixel driving circuits 10 of the second row are turned off, brightness differences among odd and even rows occur. Because the first control signal lines S11 are still turned on after the pixel driving circuits 10 in the first row are turned off while the first control signal lines S11 are turned off immediately after the pixel driving circuits 10 in the second row are turned off, so that the pixel driving circuits 10 in the first row have some more charging time. Therefore, to solve the problem of the brightness differences among odd and even rows, after the pixel driving circuits 10 of the second row are turned off, the first control signal lines S11 still need to be turned on for a period to reduce differences in charging time among odd and even rows, thereby alleviating the brightness differences among the odd and even rows. Therefore, the first control signal lines S11 also affect potential of the data signals of the first nodes N1 in the pixel driving circuits 10. In the present disclosure, the light-emitting control signal lines EM are arranged around the first control signal lines S11, the high-level pulses of signals on the light-emitting control signal lines EM cover entire high-level pulses of signals on the first control signal lines S11, so that no crosstalk is caused to the signals on the first control signal lines S11. The pixel driving circuits 10 start writing data signals only when high-level pulses appear on the drive signal lines SP. After the high-level pulses of signals on the drive signal lines SP end, the signals on the first control signal lines S11 maintains the high-level pulses for a period, so a crosstalk among signals has been weakened by a subsequent extension of charging time. Therefore, a crosstalk among signals on the first control signal lines S11, the second control signal lines S12, the third control signal lines S13, the drive signal lines SP and the light-emitting control signal lines EM is effectively reduced.

Figure 17:
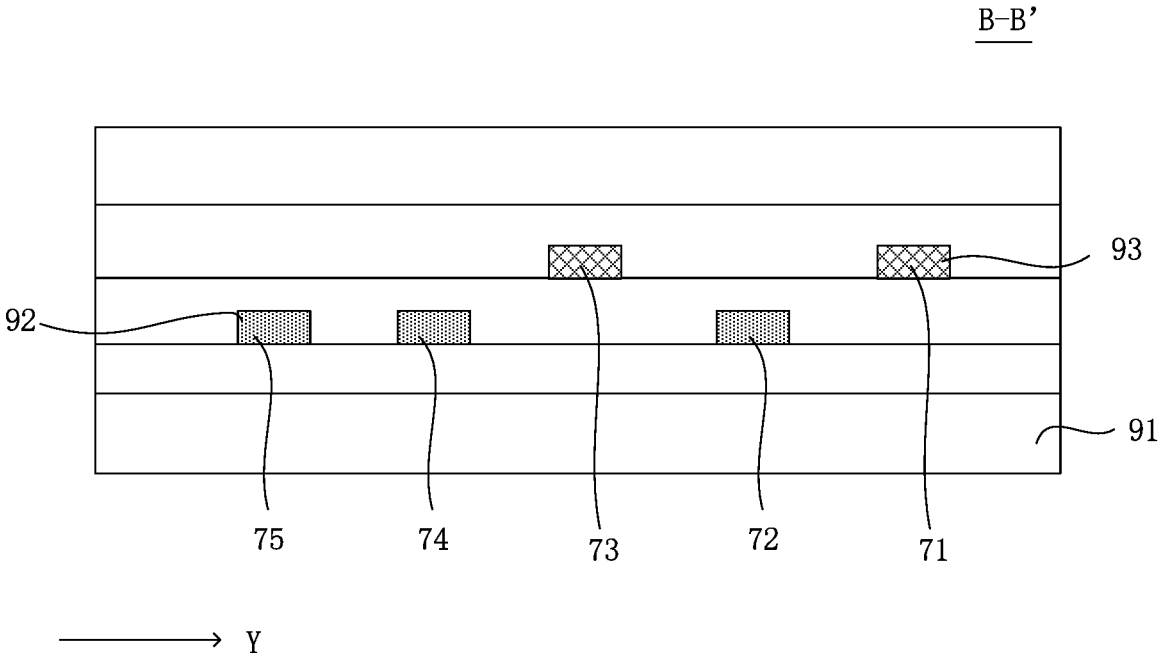
FIG. 17 illustrates a cross-sectional view of the display panel shown in FIG. 16 along B-B'.
Figure 18:
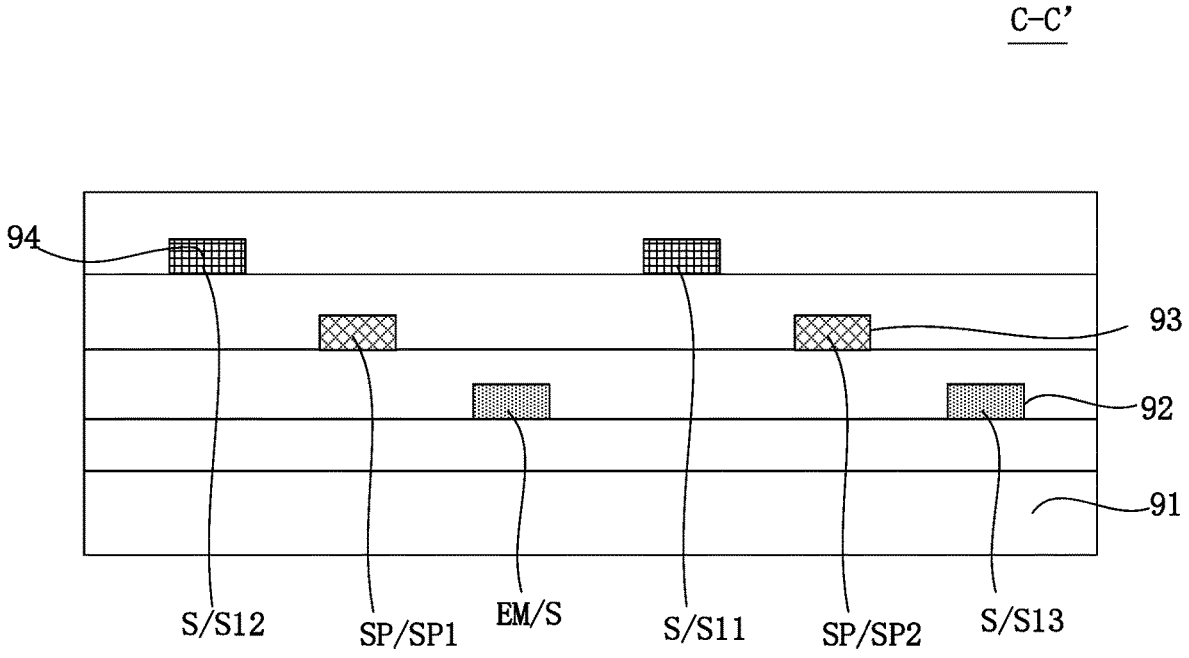
FIG. 18 illustrates a cross-sectional view of the display panel shown in FIG. 16 along C-C'.

It should be noted that the present disclosure only exemplarily illustrates an arrangement sequence of the second control signal lines S12, the second drive signal lines SP1, the light-emitting control signal lines EM, the first control signal lines S11, the third drive signal lines SP2, and the third control signal lines S13. In other embodiments, the arrangement sequence of the second control signal lines S12, the second drive signal lines SP1, the light-emitting control signal lines EM, the first control signal lines S11, the third drive signal lines SP2, and the third control signal lines S13 may only partially satisfy the arrangement sequence in the above embodiment, which is not detailed herein. FIG. 17 illustrates a cross-sectional view of the display panel shown in FIG. 16 along B-B'. FIG. 18 illustrates a cross-sectional view of the display panel shown in FIG. 16 along C-C'. Referring to FIGS. 3A, 16-18, in some optional embodiments, the display panel includes a base substrate 91, and a first metal layer 92, a second metal layer 93 and a first metal layer 92, a second metal layer 93 that are sequentially arranged on a side of the base substrate 91. The first metal layer 92, the second metal layer 93 and the third metal layer 94 are insulated from each other.

The first signal transmission lines 71 and the third signal transmission lines 73 are on the second metal layer 92. The second signal transmission lines 72, the fourth signal transmission lines 74 and the fifth signal transmission lines 75 are on the first metal layer 91.

On the basis of reducing a difficulty of changing lines by arranging the first signal transmission lines 71 to the fifth signal transmission lines 75 on film layers and reducing mutual interferences among signals on the first control signal lines S11, the second control signal lines S12, the third control signal lines S13, the drive signal lines SP and the light-emitting control signal line EM, the second control signal lines S12 and the first control signal lines S11 that are electrically connected to the drive circuits 10 in the pixel row group P20 can be arranged on the third metal layer 94. The second drive signal lines SP1 and the third drive signal lines SP2 that are electrically connected to the drive circuits 10 in the pixel row group P20 are on the second metal layer 93, and the light-emitting control signal lines EM and the third control signal lines S13 that are electrically connected to the drive circuits 10 in the pixel row group P20 are on the first metal layer 92.

Since in the first non-display area BA, along the second direction Y, the second control signal lines S12, the second drive signal lines SP1, the light emitting control signal lines EM, the control signal lines S11, the third drive signal lines SP2, and the third control signal lines S13 that are electrically connected to the drive circuits 10 in the same pixel row group P20 are arranged in sequence. The second control signal lines S12 and the first control signal lines S11 that are electrically connected to the drive circuits 10 in the pixel row group P20 are on the third metal layer 94. The second drive signal lines SP1 and the third drive signal lines SP2 that are electrically connected to the drive circuits 10 in the pixel row group P20 are on the second metal layer 93. The light-emitting control signal lines EM and the third control signal lines S13 that are electrically connected to the drive circuits 10 in the pixel row group P20 are on the first metal layer 92. That is, the second control signal lines S12, the second drive signal lines SP1, the light-emitting control signal lines EM, the first control signal lines S11, the third drive signal lines SP2, and the third control signal lines S13 can be alternately arranged on three different metal layers in turn, which is conductive to reducing signal interferences among the second control signal lines S12, the second drive signal lines SP1, the light-emitting control signal lines EM, the first control signal lines S11, the third drive signal lines SP2 and the third control signal lines S13.

Figure 19:
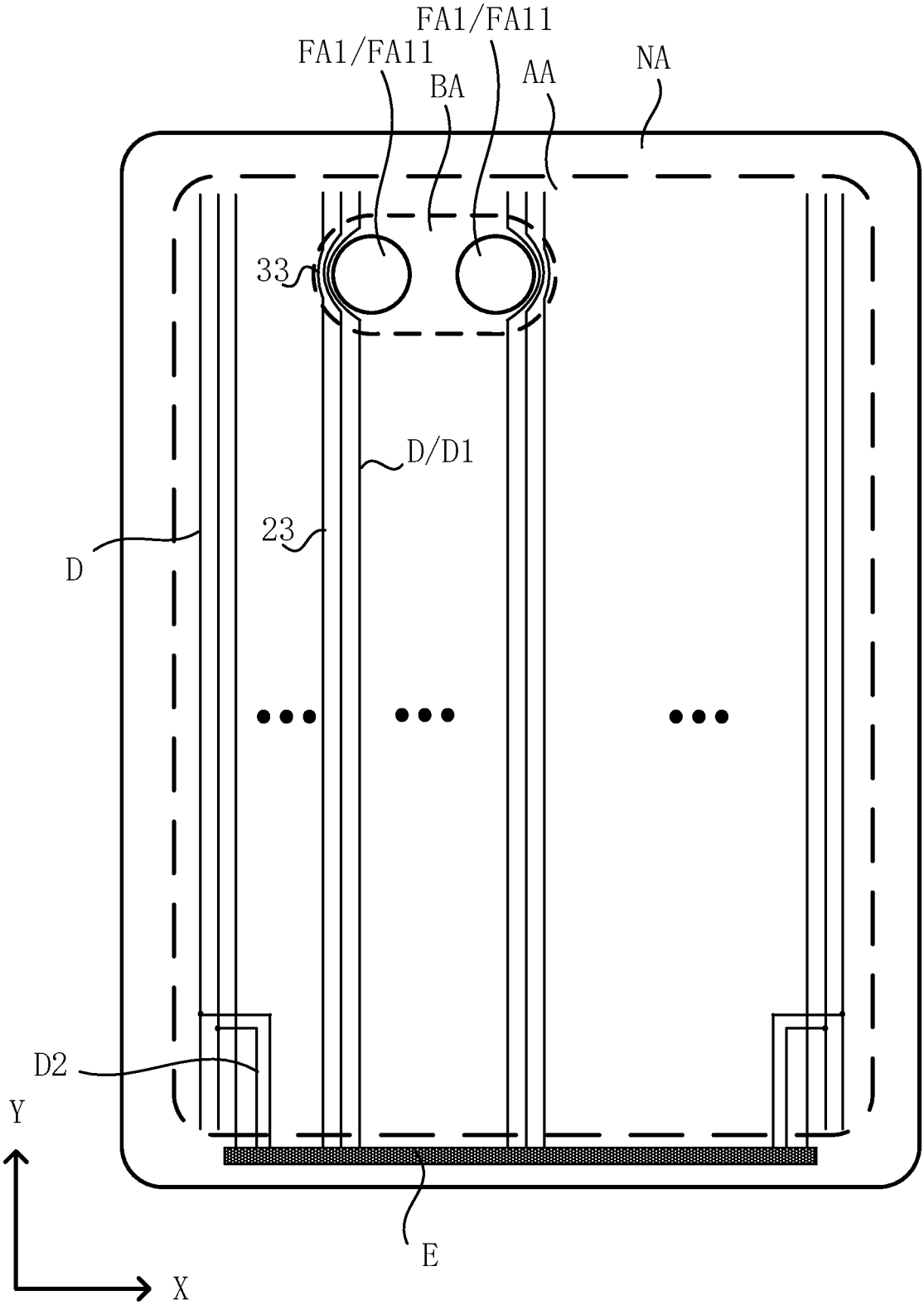
FIG. 19 illustrates a planar view of another display panel consistent with various embodiments of the present disclosure.
Figure 20:
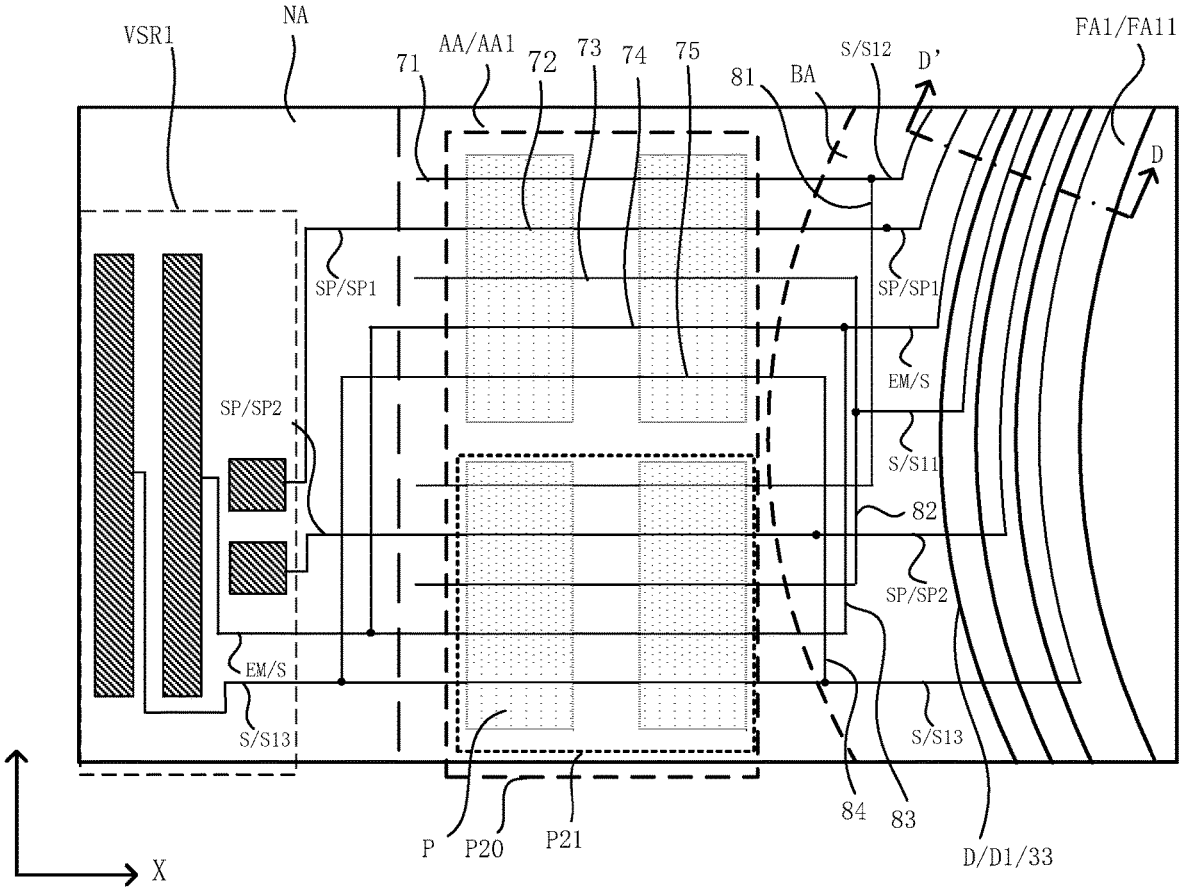
FIG. 20 illustrates a partial schematic diagram of the display panel shown in FIG. 19.
Figure 21:
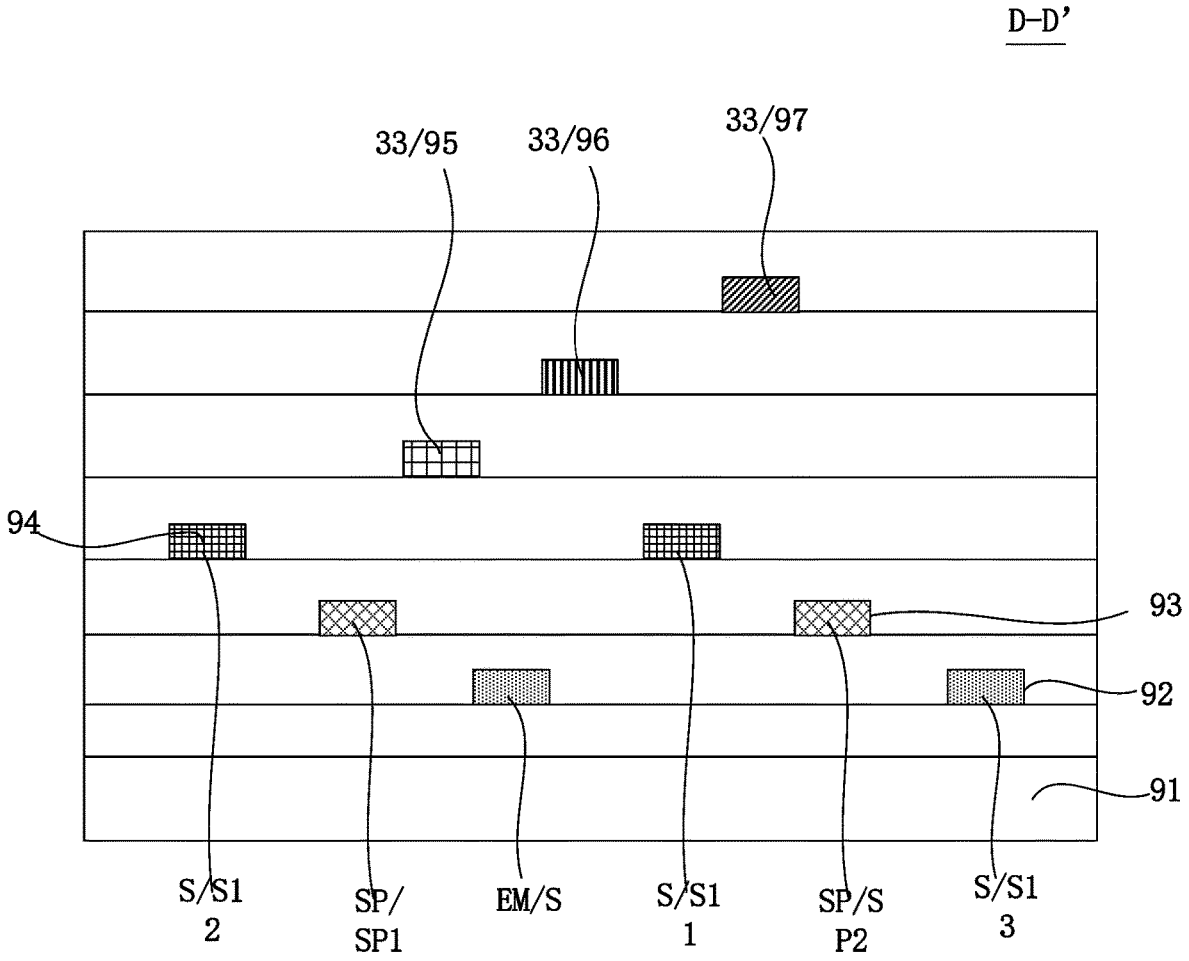
FIG. 21 illustrates a cross-sectional view of the display panel shown in FIG. 16 along D-D'.

FIG. 19 illustrates a planar view of another display panel consistent with various embodiments of the present disclosure. FIG. 20 illustrates a partial schematic diagram of the display panel shown in FIG. 19. FIG. 21 illustrates a cross-sectional view of the display panel shown in FIG. 16 along D-D'. Referring to FIGS. 19-21, in some optional embodiments, the display panel includes a plurality of data lines D. The plurality of data lines D includes first data lines D1, a first data line D1 includes a third line segment 23 in the display area AA and a third connection line segment 33 located in the first non-display area BA and connected to the third line segment 23. The third line segment 33 is on a side of the first light-transmitting group FA1 along the second direction Y. Due to a setting of the first light transmission group FA1 and the first non-display area BA, at least one first data line D1 is in the display panel, and the third line segments 23 in the first data lines D1 are in the display area AA, and the third connection line segment 33 connected to the third line segment 23 is in the first non-display area BA, to realize signal transmissions on the first data lines D1.

It should be noted that, to clearly illustrate an arrangement of the first data lines D1, FIGS. 19 and 20 only illustrate that an area of the first non-display area BA on a side of the first light-transmitting group FA1 along the second direction Y includes three third connection line segments 33. In an actual product provided by the present disclosure, the area of the first non-display area BA in the display panel on the side of the first light-transmitting group FA1 along the second direction Y may include another number of third connection line segments 33, which is not specifically limited herein and can be arranged according to actual production needs.

The display panel further includes a fourth metal layer 95, a fifth metal layer 96 and a sixth metal layer 97 arranged in sequence on a side of the third metal layer 94 away from the base substrate 91. The third line segments 23 are on the fifth metal layer 95. Part of the data lines D is electrically connected to data pads E through dummy data lines D2 in the display area AA, and the dummy data lines D2 are at least partially on the sixth metal layer 97. That is, part of the data lines D can be electrically connected to the data pads E through the dummy data lines D2, and the dummy data lines D2 are in the display area AA, which is conductive to reducing a size of the frame area NA.

Part of the third connection line segments 33 are on the fourth metal layer 95, part of the third connection line segment 33 are on the fifth metal layer 96, part of the third connection line segment 33 are on the sixth metal layer 97. Along a direction that the first non-display area BA points to the display area AA, the third connection line segments 33 on the fourth metal layer 95, the third connection line segments 33 on the fifth metal layer 96 and the third connection line segments 33 on the sixth metal layer 97 are alternately arranged. That is, the third connection line segments 33 are arranged on three different metal layers in a staggered manner, which is conductive to reducing signal interferences among the third connection line segments 33.

Meanwhile, the second control signal lines S12 and the first control signal lines S11 are on the third metal layer 94, the second drive signal lines SP1 and the third drive signal lines SP2 are on the second metal layer 93, and the light-emitting control signal lines EM and the third control signal lines S13 are on the first metal layer 92, so that a wiring setting of the second control signal line S12, the second drive signal lines SP1, the light-emitting control signal lines EM, the first control signal lines S11, the third drive signal lines SP2 and the third control signal line S13 in the first non-display area BA does not affect a wiring setting of the third connection line segments 33 in the first data lines D1, which is conductive to reducing signal interferences among the second control signal lines S12, the second drive signal lines SP1, the light-emitting control signal lines EM, the first control signal lines S11, the third drive signal lines SP2, the third control signal lines S13 and the first data lines D1 and reduce distances among the second control signal lines S12, the second drive signal lines SP1, the light-emitting control signal lines EM, the first control signal lines S11, the third drive signal lines SP2, the third control signal lines S13 and the first data lines D1, thereby reducing a size of the first non-display area BA.

Referring to FIGS. 19-21, in some optional embodiments, at least part of the first connection line 81 to the fourth connection line 84 are on the sixth metal layer 97, so that signal interferences among the first connection line 81 to the fourth connection line 84, the first signal transmission line 71 to the fifth signal transmission line 75, the second control signal lines S12, the second drive signal lines SP1, the light-emitting control signal lines EM, the first control signal lines S11, the third drive signal lines SP2, and the third control signal lines S13 can be avoided. Therefore, the first connection line 81 to the fourth connection line 84 are insulated from each other, the first signal transmission line 71 to the fifth signal transmission line 75 are insulated from each other, and the second control signal lines S12, the second drive signal lines SP1, the light-emitting control signal lines EM, the first control signal lines S11, the third drive signal lines SP2, and the third control signal lines S13 are insulated from each other.

Referring to FIGS. 19-21, in some optional embodiments, the third connection line segments 33 are respectively arranged on two sides of the first light-transmitting group FA1 along the first direction X. That is, the third connection line segments 33 do not extend through an area between two adjacent first light-transmitting areas FA11 in the first light-transmitting group FA1, which can effectively increase a light transmittance of the area between the two adjacent first light transmittance areas FA11 in the first light transmittance group FA1, can arrange an electronic photosensitive device in the area between the two adjacent first light-transmitting areas FA11 in the first light-transmitting group FA1, and is conductive to performing a load compensation setting on the drive signal line SP in the area between the two adjacent first light-transmitting areas FA11 in the first light-transmitting group FA1.

Figure 22:
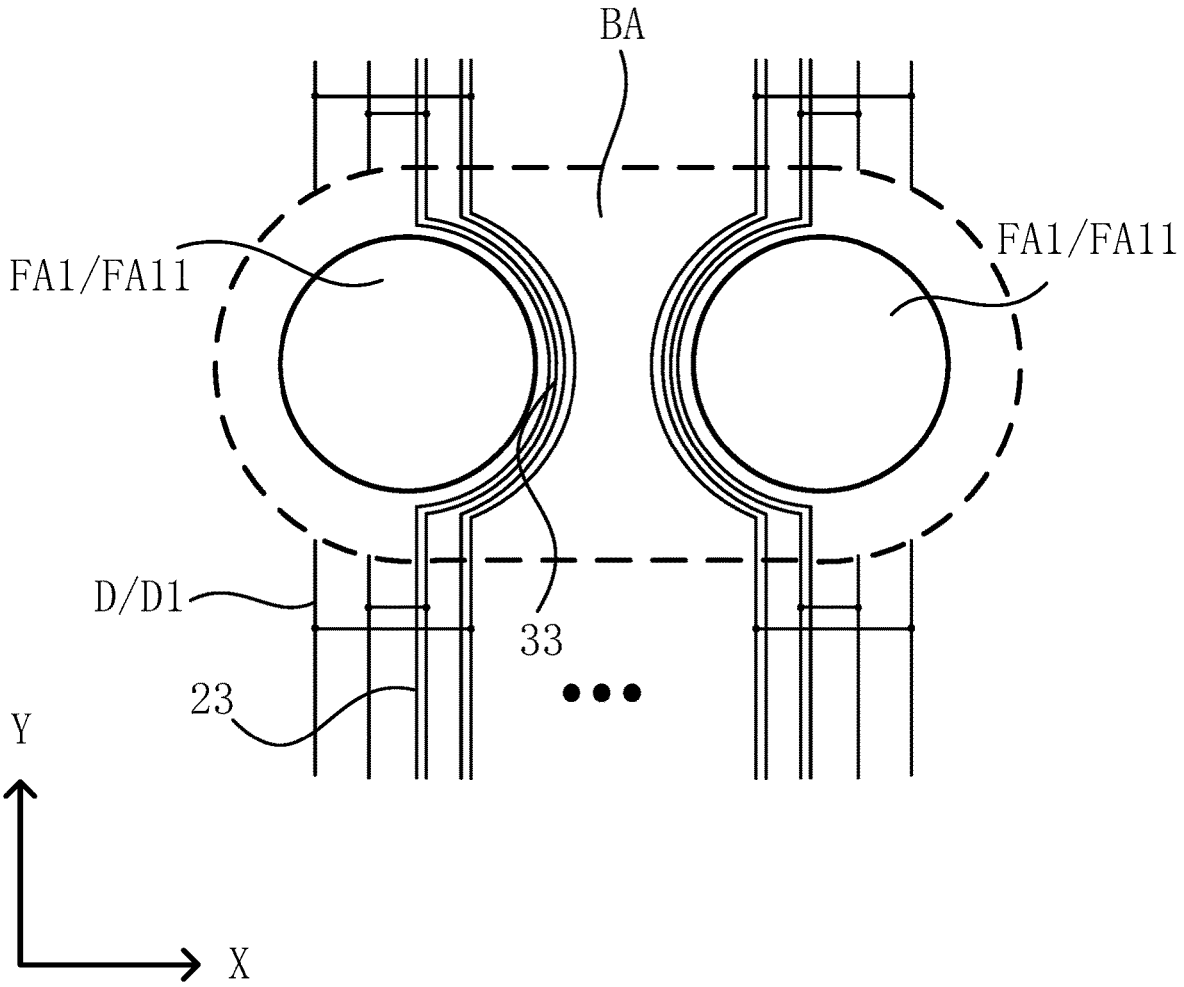
FIG. 22 illustrates a partial plan view of another display panel consistent with various embodiments of the present disclosure.

FIG. 22 illustrates a partial plan view of another display panel consistent with various embodiments of the present disclosure. Referring to FIG. 22, in some optional embodiments, each third connection line segment 33 extends through an area between two adjacent first light-transmitting areas FA11 in the first light-transmitting group FA1, to facilitate a wiring setting of drive signal lines and control signal lines electrically connected to the pixel driving circuits in the first non-display area BA and in areas on two sides of the first light-transmitting group FA1 along the first direction X. Optionally, part of the first data lines D1 can be designed with dummy connection lines in the area between the two adjacent first light-transmitting areas FA11 in the first light-transmitting group FA1, which is conductive to reducing an area of the first non-display area BA and realizing a narrow frame.

Figure 23:
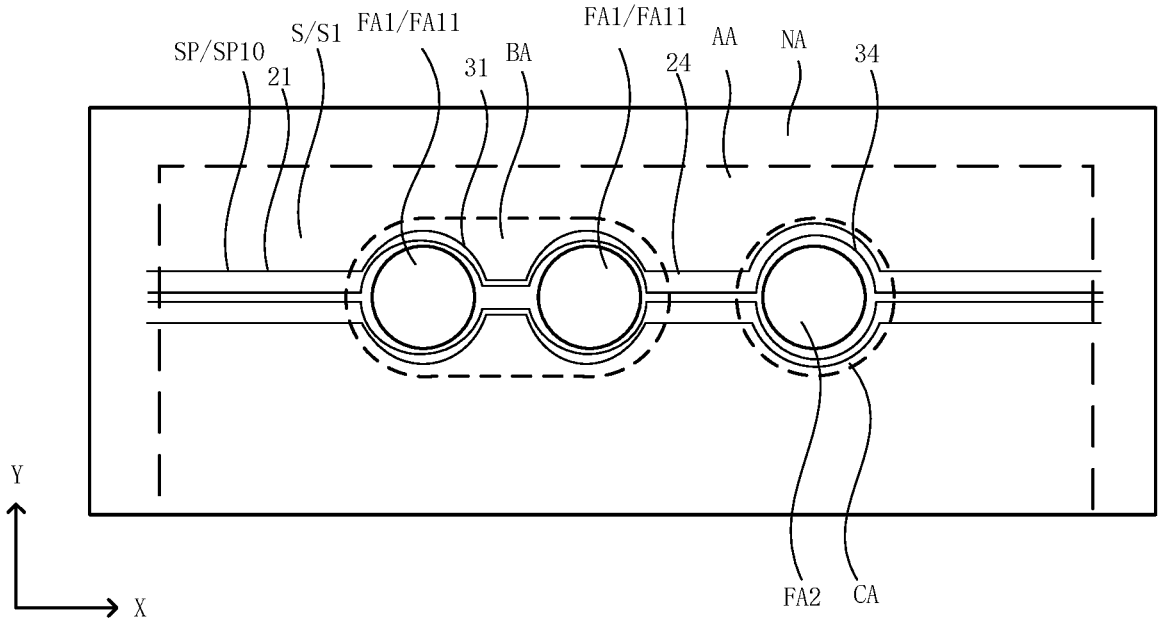
FIG. 23 illustrates a partial plan view of another display panel consistent with various embodiments of the present disclosure.

FIG. 23 illustrates a partial plan view of another display panel consistent with various embodiments of the present disclosure. Referring to FIG. 23, in some optional embodiments, the display panel further includes a second light transmission area FA2 and a second non-display area CA. The second light-transmitting area FA2 also has a better light transmittance. Devices such as photosensitive elements can be arranged in the area corresponding to the second light-transmitting area FA2. The second non-display area CA surrounds the second light transmission area FA2, the display area AA surrounds the second non-display area CA. The second light transmission area FA2 and the first light transmission group FA1 are arranged along the first direction X.

Optionally, a vertical projection pattern of the second light-transmitting area FA2 on the plane where the display panel is located is a circle. In other embodiments, the vertical projection pattern of the second light-transmitting area FA2 on the plane where the display panel is located may also be another shape such as a rectangle, an ellipse, or the like, which is not specifically limited herein, and may be determined according to actual conditions.

The first drive signal line SP10 further includes a fourth line segment 24 in the display area AA and a fourth connection line segment 34 in the second non-display area CA. Along the first direction X, the fourth line segment 24 is between the second light-transmitting area FA2 and the first light-transmitting group FA1, the fourth line segment 24 is connected to the first connection line segment 31 and the fourth connection line segment 34, and the fourth connection line segment 34 partially surrounds the second light-transmitting area FA2, thereby realizing a signal transmission on the fourth line segment 24 between the second light-transmitting area FA2 and the first light-transmitting group FA1, and realizing a normal display of an area of the display area AA between the second light transmission area FA2 and the first light transmission group FA1.

Figure 24:
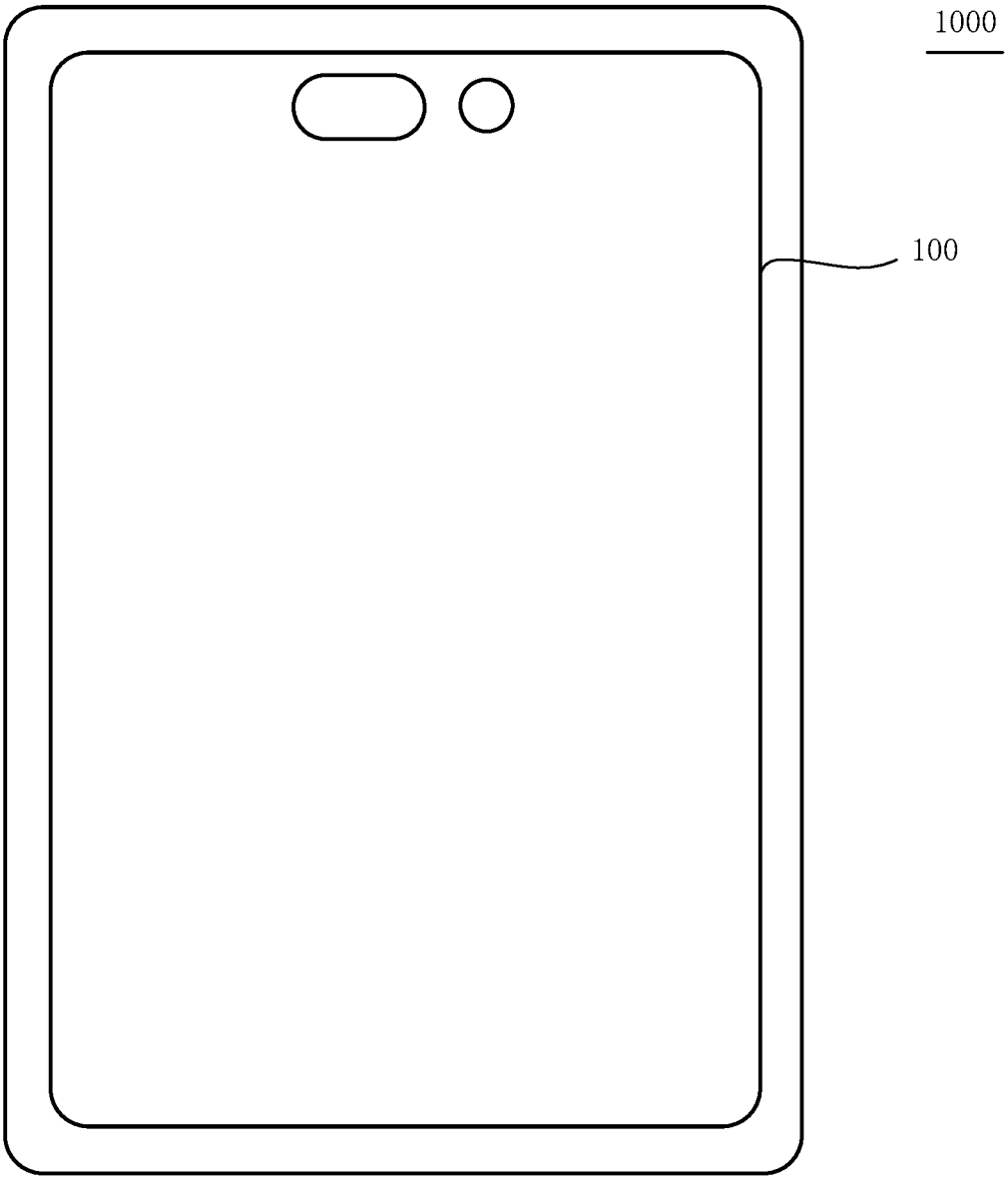
FIG. 24 illustrates a planar view of a display device consistent with various embodiments of the present disclosure.

In some optional embodiments, FIG. 24 illustrates a planar view of a display device consistent with various embodiments of the present disclosure. In one embodiment, the display device 1000 includes a display panel 100 provided by any of the above embodiments of the present disclosure. The embodiment of FIG. 24 only takes a mobile phone as an example to describe the display device 1000. It can be understood that the display device 1000 provided by the embodiment may also be a computer, a television, a vehicle-mounted display device, or another display device 1000 having a display function, which is not specifically limited herein. The display device 1000 provided by the embodiment has beneficial effects of the display panel 100 provided by the embodiments of the present disclosure. Details can be referred to specific descriptions of the display panel 100 in the above embodiments, which are not repeated herein.

As disclosed, the display panel and the display device provided by the present disclosure achieve at least the following beneficial effects.

The display panel provided by the present disclosure includes a plurality of pixel driving circuits and a plurality of drive signal lines. The plurality of pixel driving circuits is in the display area and includes data writing modules, and the plurality of drive signal lines is electrically connected to control terminals of the data writing modules. A turning-on or turning-off of a data writing module is controlled by a signal on the drive signal line, so that a writing time of data signals in the pixel driving circuits can be controlled. The drive signal lines in the display panel includes first drive signal lines, and a first drive signal line includes a first line segment in the display area and a first connection line segment located in the first non-display area and connected to the first line segment. The first line segments are on a side of the first light-transmitting group along the first direction. Due to an arrangement of the first light-transmitting group and the first non-display area, at least one first drive signal line is arranged in the display panel, the first line segment of the first drive signal line is in the display area, and the first connection line segment connected to the first line segment is in the first non-display area, to realize a signal transmission on the first drive signal line. The drive signal lines in the display panel also include conventional drive signal lines, the conventional drive signal lines do not extend through the first non-display area, the first drive signal lines extend through the first non-display area, and the pixel driving circuits are in the display area, so that number of pixel driving circuits electrically connected to a conventional drive signal line is greater than number of pixel driving circuits electrically connected to the first drive signal line. The first connection line segment at least partially surrounds the first light-transmitting area, and the first connection line segment is at least partially located between two adjacent first light-transmitting areas, i.e., the first connection line segment in the first drive signal line can be wound in an area between two adjacent first light-transmitting areas in the first light-transmitting group, which effectively increases a set length of the first connection line segment in the first drive signal line. Therefore, a resistance value of the first drive signal line can be increased, and a load on the first drive signal line can be increased, thereby effectively alleviating a load difference caused by a difference between number of pixel driving circuits electrically connected to the first drive signal line and number of pixel driving circuits electrically connected to the conventional drive signal line, effectively alleviating a difference between a writing time of data signals in the pixel driving circuits electrically connected with the first drive signal line and a writing time of data signals in the pixel driving circuits electrically connected to the conventional drive signal line, and improving display uniformity of the display panel.

Although some specific embodiments of the present disclosure have been described in detail by way of examples, a person skilled in the art should understand that the above examples are provided for illustration only and are not intended to limit the scope of the present disclosure. A person skilled in the art should understand that modifications may be made to the above embodiments without departing from the scope and spirit of the present disclosure. The scope of the present disclosure is defined by the appended claims.

What is claimed is:

1. A display panel, comprising:

a first light-transmitting group, a first non-display area, and a display area, the first non-display area surrounding the first light-transmitting group, the display area surrounding the first non-display area, and the first light-transmitting group including at least two first light-transmitting areas arranged along a first direction;

a plurality of pixel driving circuits and a plurality of drive signal lines, the plurality of pixel driving circuits being in the display area, a pixel driving circuit of the plurality of pixel driving circuits including a data writing module, and a drive signal line of the plurality of drive signal lines being electrically connected to a control terminal of the data writing module;

the plurality of drive signal lines including first drive signal lines, a first drive signal line including a first line segment in the display area and a first connection line segment located in the first non-display area and connected to the first line segment, and the first line segment being on a side of the first light-transmitting group along the first direction; and the first connection line segment at least partially surrounding the first light-transmitting areas and being at least partially between two adjacent first light-transmitting areas.

2. The display panel according to claim 1, wherein:

the first non-display area includes a compensation area between two adjacent first light-transmitting areas, the compensation area includes a plurality of compensation parts, and the first connection line segment is electrically connected to a compensation part of the plurality of compensation parts.

3. The display panel according to claim 2, wherein a compensation part of the plurality of compensation parts includes a first capacitor and part of the first connection line segment is multiplexed as a first plate of the first capacitor.

4. The display panel according to claim 3, wherein:

the display area includes a plurality of subpixels arranged in an array, and a subpixel of the plurality of subpixels includes a pixel driving circuit and a light-emitting element electrically connected to the pixel driving circuit; and the first drive signal line includes a first sub-drive signal line and a second sub-drive signal line, number of subpixels electrically connected to the first sub-drive signal line is smaller than number of subpixels electrically connected to the second sub-drive signal line, and a capacitance value of the first capacitor electrically connected to the first sub-drive signal line is greater than a capacitance value of the first capacitor electrically connected to the second sub-drive signal line.

5. The display panel according to claim 4, wherein:

the display panel includes a plurality of first power signal lines, part of the plurality of first power signal lines includes first subsections in the compensation area;

the compensation area includes a plurality of conductive parts electrically connected to the first subsections, and part of a conductive part is multiplexed as a second plate of the first capacitor; and in a direction perpendicular to a plane where the display panel is located, an overlapping portion of the first connection line segment and the conductive part forms the first capacitor.

6. The display panel according to claim 5, wherein:

the first subsections extend along a second direction, the first direction intersects and the second direction;

a conductive part includes a plurality of conductive line segments extending along the second direction, and one conductive line segment is electrically connected to at least one first subsection through a via hole;

the first drive signal line includes a curved line portion in the compensation area;

the first capacitor includes a plurality of first sub-capacitors, at each intersection of the curved line portion and a conductive line segment, along the direction perpendicular to the plane where the display panel is located, overlapping portions of curved line portions and the plurality of conductive line segments all form first sub-capacitors; and number of first sub-capacitors electrically connected to the first sub-drive signal line is greater than number of first sub-capacitors electrically connected to the second sub-drive signal line.

7. The display panel according to claim 6, wherein a width of the conductive line segment in the first direction is greater than a width of a first subsection in the first direction.

8. The display panel according to claim 2, wherein a compensation part of the plurality of compensation parts includes dummy subpixels.

9. The display panel according to claim 8, wherein: the display area includes a plurality of subpixels arranged in an array, a subpixel of the plurality of subpixels includes a pixel driving circuit and a light-emitting element electrically connected to the pixel driving circuit; the first drive signal line includes a first sub-drive signal line and a second sub-drive signal line, and number of subpixels electrically connected to the first sub-drive signal line is smaller than number of subpixels electrically connected to the second sub-drive signal line, number of dummy subpixels electrically connected to the first sub-drive signal line is greater than number of dummy subpixels electrically connected to the second sub-drive signal line; and the compensation area at least partially surrounds any one of the first light-transmitting areas adjacent to the compensation area, and a spacing between the compensation area and the any one of the first light-transmitting areas adjacent to the compensation area in the first direction is smaller than a spacing between the compensation area and another adjacent first light-transmitting area in the first direction.

10. The display panel according to claim 1, further comprising control signal lines electrically connected to the plurality of pixel driving circuits, wherein:

the control signal lines include a first signal line including a second line segment in the display area and a second connection line segment located in the first non-display area and connected to the second line segment, and the second line segment is on a side of the first light-transmitting group along the first direction; and the second connection line segment extends along an extending direction of an edge of the first non-display area.

11. The display panel according to claim 1, further comprising:

a frame area surrounding the display area, the frame area including a first frame area and a second frame area, and the first frame area and the second frame area being oppositely arranged along the first direction;

a first shift register and a second shift register, the first shift register being in the first frame area, and the second shift register being in the second frame area; and control signal lines electrically connected to the plurality of pixel driving circuits; the plurality of drive signal lines being electrically connected to the first shift register and the second shift register, wherein:

part of the control signal lines is electrically connected to the first shift register, and a remaining part of the control signal lines are electrically connected to the second shift register.

12. The display panel according to claim 1, further comprising control signal lines electrically connected to the plurality of pixel driving circuits, wherein:

a pixel driving circuit of the plurality of pixel driving circuits further includes a driving transistor, a compensation module, a first reset module, a second reset module, a first lighting control module, a second lighting control module and a voltage adjustment module, a gate of the drive transistor is electrically connected to a first node, a first electrode of the drive transistor is electrically connected to a second node, a second electrode of the drive transistor is electrically connected to a third node, the data writing module is electrically connected to the second node, the compensation module is connected to the first node and the third node, the first reset module is electrically connected to the first node, the second reset module is electrically connected to a fourth node, the first lighting control module is electrically connected to the second node, the second lighting control module is electrically connected to the third node and the fourth node, and the voltage adjustment module is electrically connected to the second node; and the control signal lines include first control signal lines, second control signal lines, third control signal lines and light-emitting control signal lines, control terminals of compensation modules are electrically connected to the first control signal lines, control terminals of first reset modules are electrically connected to the second control signal lines, control terminals of second reset modules are electrically connected to the third control signal lines, and control terminals of first lighting control modules and second lighting control modules are all electrically connected to the light-emitting control signal lines, and control terminals of voltage adjustment modules are electrically connected to the third control signal lines.

13. The display panel according to claim 1, wherein: the display area includes at least one first display area on a side of the first light-transmitting area along the first direction; the first display area includes a plurality of pixel row groups, one of the plurality of pixel row groups includes two pixel rows, a pixel row of the two pixel rows includes a plurality of subpixels arranged along the first direction, and a subpixel of the plurality of subpixels includes a pixel driving circuit and a light-emitting element electrically connected to the pixel driving circuit; in a same pixel row group, each pixel driving circuit is electrically connected to a same first control signal line, each pixel driving circuit is electrically connected to a same second control signal line, each pixel driving circuit is electrically connected to a same third control signal line, and each pixel driving circuit is electrically connected to a same light-emitting control signal line;

and in a same pixel row, each pixel driving circuit is electrically connected to a same drive control signal line, and pixel driving circuits in different pixel rows are electrically connected to different drive control signal lines.

14. The display panel according to claim 13, wherein: one of the second control signal lines is electrically connected to two first signal transmission lines in the first display area through a first connection line, the two first signal transmission lines are respectively electrically connected to the pixel driving circuits in different pixel rows; one of the drive signal lines is electrically connected to a second signal transmission line in the first display area; one of the first control signal lines is electrically connected to two third signal transmission lines in the first display area through a second connection line, the two third signal transmission lines are respectively electrically connected to the pixel driving circuits in different pixel rows; one of the light-emitting control signal lines is electrically connected to two fourth signal transmission lines in the first display area through a third connection line, the two fourth signal transmission lines are respectively electrically connected to the pixel driving circuits in different pixel rows; one of the third control signal lines is electrically connected to two fifth signal transmission lines in the first display area through a fourth connection line, the two fifth signal transmission lines are respectively electrically connected to the pixel driving circuits in different pixel rows; along a second direction, the first signal transmission lines to the fifth signal transmission lines electrically connected to the pixel driving circuits in a same pixel row are arranged in sequence, and the first direction intersects the second direction; in a same pixel row group, the two pixel rows are an N-th pixel row and an (N+1)-th pixel row, N21, and N is a positive integer; the drive signal line electrically connected to each of the pixel driving circuits in the N-th pixel row is a second drive signal line, and the drive signal line electrically connected to each of the pixel driving circuits in the (N+1)-th pixel row is a third drive signal line; and in the first non-display area, along the second direction, the second control signal lines, the second drive signal lines, the light-emitting control signal lines, the first control signal lines, the third drive signal lines, and the third control signal lines that are electrically connected to the pixel driving circuits in a same pixel row group are arranged in sequence.

15. The display panel according to claim 14, further comprising a base substrate, and a first metal layer, a second metal layer and a third metal layer sequentially arranged on a side of the base substrate, wherein: the first signal transmission lines and the third signal transmission lines are on the second metal layer, the second signal transmission lines, the fourth signal transmission lines and the fifth signal transmission lines are on the first metal layer, in the first non-display area, the second control signal lines and the first control signal lines electrically connected to the drive circuits in the plurality of pixel row groups are on the third metal layer, the second drive signal lines and the third drive signal lines electrically connected to the drive circuits in the plurality of pixel row groups are on the second metal layer, and the light-emitting control signal lines and the third control signal lines electrically connected to the drive circuits in the plurality of pixel row groups are on the first metal layer.

16. The display panel according to claim 15, further comprising: a plurality of data lines, including first data lines, a first data line including a third line segment in the display area and a third connection line segment located in the first non-display area and connected to the third line segment, the third line segment being on a side of the first light-transmitting group along the second direction; a fourth metal layer, a fifth metal layer and a sixth metal layer which are arranged in sequence on the side of the third metal layer away from the base substrate; the third line segment being on the fifth metal layer, part of the data lines being electrically connected to data pads through dummy data lines in the display area, and at least part of the dummy data lines being on the sixth metal layer; part of third connection line segments being on the fourth metal layer, part of the third connection line segments being on the fifth metal layer, and part of the third connection line segments being on the sixth metal layer; and along a direction that the first non-display area points to the display area, the third connection line segments on the fourth metal layer, the third connection line segments on the fifth metal layer, and the third connection line segments on the sixth metal layer being alternately arranged.

17. The display panel according to claim 16, wherein at least part of the first connection line segments to the fourth connection line segments are on the sixth metal layer.

18. The display panel according to claim 16, wherein all the third connection line segments are respectively arranged on two sides of the first light-transmitting group along the first direction.

19. The display panel according to claim 1, further comprising a second light-transmitting area and a second non-display area, wherein:

the second non-display area surrounds the second light-transmitting area, the display area surrounds the second non-display area, the second light-transmitting area and the first light-transmitting group are arranged along the first direction; and the first drive signal line further includes a fourth line segment in the display area and a fourth connection line segment in the second non-display area, along the first direction, the fourth line segment is between the second light-transmitting area and the first light-transmitting group, and the fourth line segment is connected to the first connection line segment and the fourth connection line segment, the fourth connection line segment partially surrounds the second light-transmitting area.

20. A display device, comprising a display panel comprising:

a first light-transmitting group, a first non-display area, and a display area, the first non-display area surrounding the first light-transmitting group, the display area surrounding the first non-display area, and the first light-transmitting group including at least two first light-transmitting areas arranged along a first direction;

a plurality of pixel driving circuits and a plurality of drive signal lines, the plurality of pixel driving circuits being in the display area, a pixel driving circuit of the plurality of pixel driving circuits including a data writing module, and a drive signal line of the plurality of drive signal lines being electrically connected to a control terminal of the data writing module;

the plurality of drive signal lines including first drive signal lines, a first drive signal line including a first line segment in the display area and a first connection line segment located in the first non-display area and connected to the first line segment, and the first line segment being on a side of the first light-transmitting group along the first direction; and the first connection line segment at least partially surrounding the first light-transmitting areas and being at least partially between two adjacent first light-transmitting areas.

* * * * *